US005303016A

United States Patent [19]

Oda et al.

[11] Patent Number: 5,303,016

[45] Date of Patent: Apr. 12, 1994

[54] IMAGE FIXING DEVICE FOR IMAGE FORMING APPARATUS INCLUDING MEANS FOR LOCALLY HEATING INNER WALL OF FIXING MEANS AT LOCATION CORRESPONDING TO NIP

[75] Inventors: Katsunari Oda; Akiyoshi Kamisaki; Norimasa Kubota, all of Machida; Teruo Narikawa, Tokyo; Tateki Oka, Atsugi, all of Japan

[73] Assignee: Minolta Camera Kabushiki Kaisha, Osaka, Japan

[21] Appl. No.: 964,391

[22] Filed: Oct. 20, 1992

[30] Foreign Application Priority Data

| | | | |
|---|---|---|---|
| Oct. 22, 1991 | [JP] | Japan | 3-302510 |
| Oct. 22, 1991 | [JP] | Japan | 3-302511 |
| Nov. 14, 1991 | [JP] | Japan | 3-298912 |
| Jan. 30, 1992 | [JP] | Japan | 4-015282 |
| Mar. 5, 1992 | [JP] | Japan | 4-083372 |
| Apr. 6, 1992 | [JP] | Japan | 4-083684 |

[51] Int. Cl.[5] ..... G03G 15/20

[52] U.S. Cl. ..... 355/289; 219/216; 355/285

[58] Field of Search ..... 355/285, 289, 290; 219/216, 388, 469; 432/60

[56] References Cited

U.S. PATENT DOCUMENTS

| | | | |
|---|---|---|---|
| 3,811,828 | 5/1974 | Ohta et al. | 219/216 |
| 4,163,892 | 8/1979 | Komatsu | 219/216 |
| 4,377,336 | 3/1983 | Parks et al. | 219/388 X |
| 4,395,109 | 7/1983 | Nakajima | 219/216 |
| 4,563,073 | 1/1986 | Reynolds et al. | 355/3 FU |
| 4,628,183 | 12/1986 | Satomura | 219/216 |
| 4,714,427 | 12/1987 | Tsuruoka et al. | 432/59 |
| 4,813,372 | 3/1989 | Kogure | 219/216 X |
| 4,883,941 | 11/1989 | Martin et al. | 219/216 |
| 5,026,276 | 6/1991 | Hirabayashi et al. | 432/59 |
| 5,087,946 | 11/1992 | Dalal et al. | 355/285 |
| 5,115,278 | 5/1992 | Maruta et al. | 355/285 |
| 5,115,279 | 5/1992 | Nishikawa et al. | 355/290 |
| 5,151,742 | 9/1992 | Yamaguchi | 355/285 |

FOREIGN PATENT DOCUMENTS

| | | | |
|---|---|---|---|
| 0372479 | 6/1990 | European Pat. Off. . | |
| 0411852 | 2/1991 | European Pat. Off. . | |
| 62-250471 | 10/1987 | Japan . | |
| 1-260474 | 10/1989 | Japan | 355/289 |
| 1-260476 | 10/1989 | Japan | 355/289 |
| 1-279276 | 11/1989 | Japan . | |
| 3-120572 | 5/1991 | Japan | 355/290 |
| 4-213480 | 8/1992 | Japan | 355/289 |

OTHER PUBLICATIONS

"Hard Roll Fuser," *Xerox Disclosure Journal*, vol. 1, No. 6, Jun. 1976.

*Primary Examiner*—R. L. Moses

*Attorney, Agent, or Firm*—Willian Brinks Hofer Gilson & Lione

[57] ABSTRACT

An image fixing device for an image forming apparatus, comprises a hollow cylindrical fixing roller, and cylindrical pressure roller which is kept in contact with the fixing roller so as to rotate in accordance with rotation of the fixing roller. The pressure roller cooperates with the fixing roller to form therebetween a nip extending in a direction of the longitudinal axes thereof and serving to receive a sheet to which a toner image is transferred. The fixing roller is provided with a heater for locally heating the inner wall of the fixing roller at a location corresponding to the nip to fix the toner image to the sheet.

52 Claims, 32 Drawing Sheets

IMAGE FIXING DEVICE FOR IMAGE FORMING APPARATUS INCLUDING MEANS FOR LOCALLY HEATING INNER WALL OF FIXING MEANS AT LOCATION CORRESPONDING TO NIP

BACKGROUND OF THE INVENTION

1. Field of The Invention

The present invention relates generally to an image fixing device for an image forming apparatus, such as an electrophotographic copying machine or a laser-beam printer. More particularly, the invention relates to an image fixing device for fixing a toner image to a toner sheet by heat energy.

2. Description of The Prior Art

In image forming apparatus, such as copying machines and laser-beam printers, a heat-roller type image fixing device is generally used for fixing a toner image to a toner sheet.

Such an image fixing device generally comprises a hollow fixing roller with a built-in heater serving as a heating source, and a pressure roller for pressing the fixing roller, to fix a toner image to a toner sheet by passing the sheet through a nip formed between the heating and pressure rollers.

However, in conventional heat-roller type image fixing devices, there is the disadvantage in that heat efficiency is low, since the fixing roller is heated in whole by radiation heat. There is also a design restriction in that it is necessary to arrange the heater at the center of the fixing roller in order to evenly heat the whole fixing roller.

In addition, when the fixing roller is heated in whole, the toner on the sheet which has passed through the nip remains fused by heat of the fixing roller around the nip. As a result, the toner fused by heat tends to be adhered to the fixing roller, so that there is a disadvantage in that so-called offset, in which the toner adhered to the fixing roller is again fixed to the sheet, tends to occur. It is also difficult for the sheet to be removed from the fixing roller due to adhesion of the toner remaining fused by the heat of the fixing roller around the nip, so that there is the disadvantage in that the sheet is wound onto the fixing roller causing jamming.

There is also the disadvantage in that electric power is uselessly demanded, since it is necessary to maintain the whole fixing roller at a predetermined temperature during stand-by time to prevent the offset.

There is also the disadvantage in that it takes a lot of warm-up time until the temperature of the fixing roller reaches a predetermined temperature after a main switch is turned on, so that there is a long waiting. If the temperature of the heating source is increased in order to decrease the warm-up time, there is the disadvantage in that the temperature within the image forming apparatus is also increased.

Furthermore, in some conventional image fixing devices, a temperature detector is secured to the heating source for detecting the temperature thereof. On the basis of the detected temperature, the temperature of the heating source is controlled to be constant, so that the temperature of the nip of the fixing roller is maintained within a temperature range suitable for the fixing. In such devices, since the heat produced by the heating source is transmitted to the inner wall of the fixing roller through an air layer, the temperature of the nip tends to differ from the temperature of the heating source detected by the detector. As a result, there is the disadvantage in that imperfect fixing and offset tends to occur, when the variation of temperature of the nip is so large that its temperature is out of the temperature range suitable for the fixing.

SUMMARY OF THE INVENTION

It is therefore a principal object of the present invention to eliminate the aforementioned disadvantages, and to provide an improved image fixing device which can decrease the warm-up time, prevent the offset and allow a sheet to be easily removed from a fixing roller.

It is another object of the present invention to decrease the variation of temperature of a fixing roller in the image fixing device to prevent imperfect fixing and offset.

It is another object of the present invention to efficiently transmit heat produced by a heating source to a nip in the image fixing device to prevent imperfect fixing.

It is further object of the present invention to provide the image fixing device which can stably and quietly carry out the fixing without torque variation and sliding noise.

In order to accomplish the aforementioned and other objects, an image fixing device has heating means for locally heating the inner wall of a fixing means at a location corresponding to a nip to fix a toner image to a sheet.

According to one aspect of the present invention, an image fixing device for an image forming apparatus, comprises: rotatable fixing means defining therein a space; pressure means for cooperating with the rotatable fixing means to form a nip therebetween for receiving a sheet to which a toner image is transferred, the pressure means pressing the sheet against the rotatable fixing means at the nip; and heating means, arranged in the space, for locally heating an inner wall of the fixing means at a location corresponding to the nip to fix the toner image to the sheet.

BRIEF DESCRIPTION OF THE DRAWINGS

The present invention will be understood more fully from the detailed description given herebelow and from the accompanying drawings of the preferred embodiments of the invention. However, the drawings are not intended to imply any limitation of the invention to a specific embodiment, but are for explanation and understanding only.

In the drawings:

FIGS. 3(A) and 3(B) to 12(A) and 12(B) are, respectively, laterally and longitudinally sectional views of the second to eleventh preferred embodiments of an image fixing device, according to the present invention, taken along lines perpendicular and parallel to the longitudinal axis of a fixing roller, respectively;

DESCRIPTION OF THE PREFERRED EMBODIMENT

Figure 1:
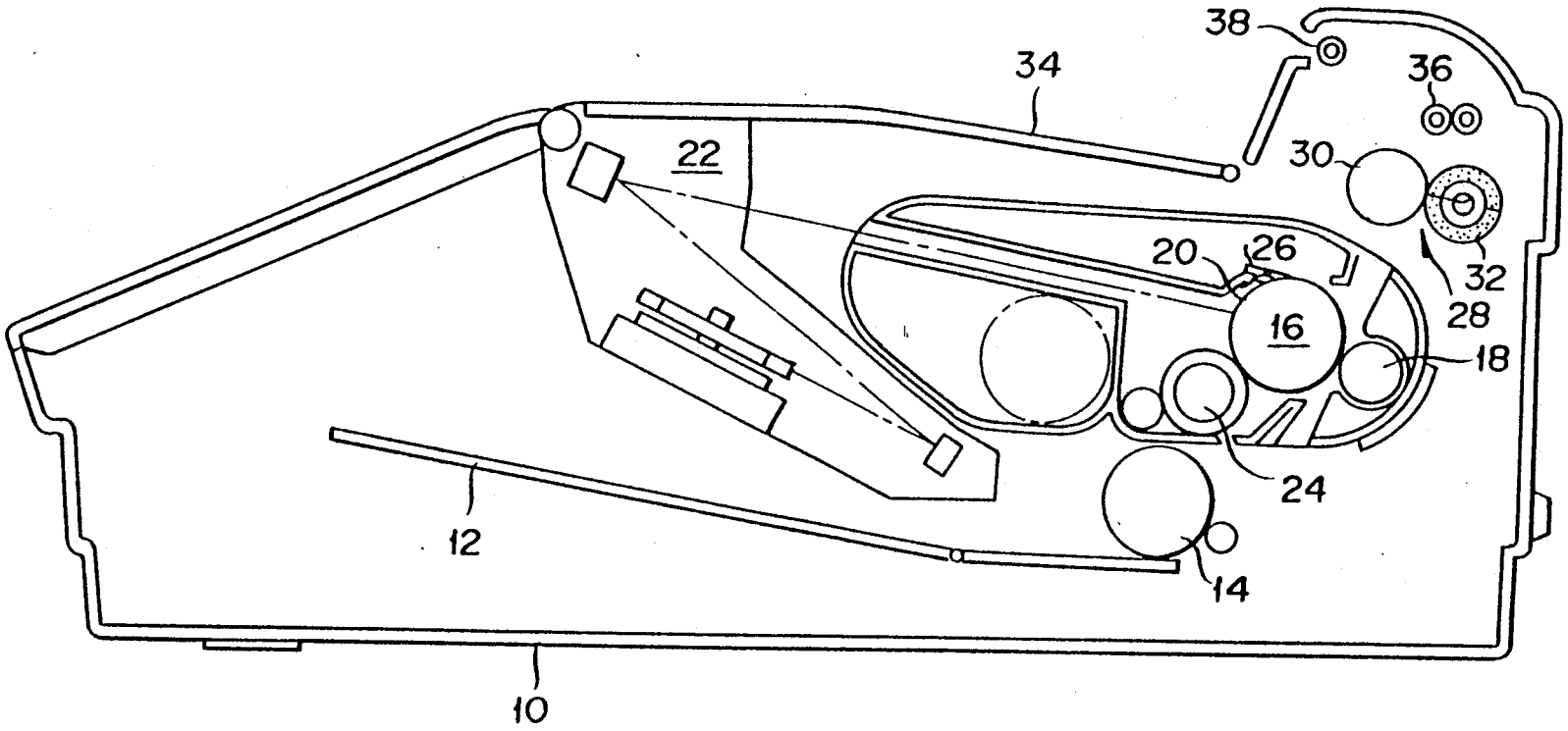
FIG. 1 is a schematic sectional view of a laser-beam printer using an image fixing device, according to the present invention.

Referring now to the drawings, particularly to FIG. 1, a laser-beam printer using an image fixing device, according to the present invention, will be described below.

As shown in FIG. 1, the laser-beam printer comprises a casing 10 in which a paper feeding tray 12 for storing sheets is provided. A rotatable feeding roller 14 is arranged near the paper feeding tray 12 to pick up the sheets. Above the feeding roller 14, a photosensitive drum 16 is arranged to cooperate with a transfer roller 18 to form a nip through which the sheet passes. A charging brush 20 is arranged near the photosensitive drum 16 to cause electrostatic charge on the surface of the photosensitive drum 16. The laser beam printer is also provided with an optical unit 22 which radiates a laser beam to the surface of the photosensitive drum 16 to form an electrostatic latent image thereon. A developing device 24 is so arranged as to contact the photosensitive drum 16. The developing device 24 serves to cause a toner to adhere to the electrostatic latent image to form a toner image thereon. By the transfer roller 18, the toner image formed on the photosensitive drum 16 is transferred to the sheet passing through the nip. After the toner image is transferred to the sheet, the residual toner on the photosensitive drum 16 is raked or cleaned by a blade 26 which is so arranged as to contact the photosensitive drum 16.

Above the photosensitive drum 16, an image fixing device 28 is so arranged as to fix the toner to the sheet to which the toner image has been transferred. The image fixing device 28 comprises a fixing roller 30 and a pressure roller 32 for pressing the sheet onto the fixing roller 30. The sheet to which the toner has been fixed is discharged to a discharge tray 34 through a carrying roller 36 and a discharge roller 38.

Figure 2:
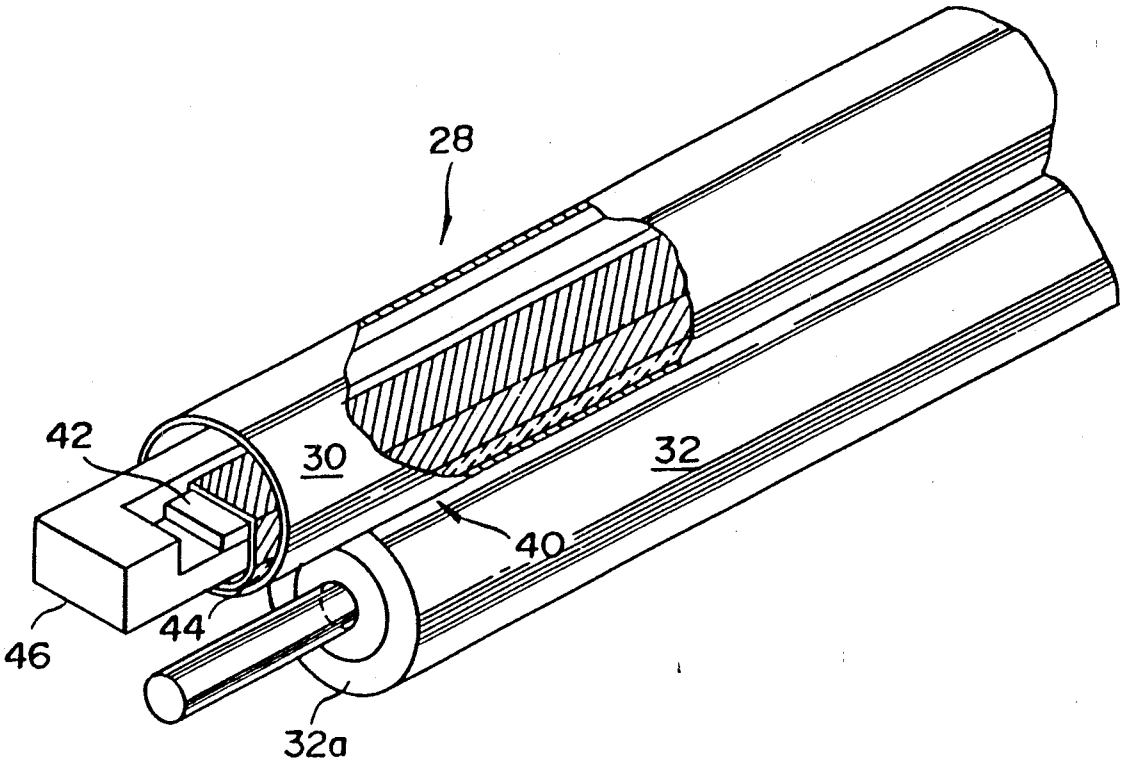
FIG. 2 is a partially cross-sectioned, perspective view of the first preferred embodiment of an image fixing device, according to the present invention.

FIG. 2 shows the first preferred embodiment of an image fixing device, according to the present invention.

As mentioned above, the fixing device 28 comprises the fixing roller 30 and the pressure roller 32. As shown in FIG. 2, the fixing roller 30 is composed of a hollow cylindrical roller, and is rotatably supported on the frame of the laser-beam printer. In order to enhance the releasability of the fixing roller 30 from the sheet, and in order to prevent offset, the peripheral surface of the fixing roller 30 is coated with polyfluoroethylene fiber. The pressure roller 32 serving as pressure means is also composed of a cylindrical roller. The pressure roller 32 is rotatably supported on the frame of the laser-beam printer so as to be allowed to rotate while pressing the fixing roller 30. The pressure roller 32 cooperates with the fixing roller 30 to form a nip 40 therebetween. The peripheral surface of the pressure roller 32 is covered with an elastic member 32*a* such as silicon sponge or rubber.

The fixing roller 30 houses therein a heating element 42, a heat conductive member 44 and a supporting member 46. The supporting member 46 is composed of an elongated rod having a substantially L-shaped cross-section. The supporting member 46 is secured to the frame of the laser-beam printer to support thereon the heating element 42. The heating element 42 is composed of an elongated strip of a resistance material to produce heat of a high temperature when voltage is applied thereto. The heat conductive member 44 is formed on a metal strip having a high thermal conductivity. The heat conductive member 44 comprises a flat upper portion which is secured to the upper surface of the heating element 42, and a lower curved portion which comes into contact with the inner wall of the fixing roller 30 at a portion corresponding to the nip 40 (a portion at which the fixing roller 30 comes into contact with the pressure roller 32). When the fixing roller 30 rotates, the curved portion of the heat conductive member slides on the inner wall of the fixing roller 30.

The operation of the laser-beam printer having the aforementioned constructions will be described below.

First, a sheet stored in the paper feeding tray 12 is carried to the nip between the photosensitive drum 16 and the transfer roller 18. The toner is transferred to the sheet at the nip, and then, the sheet is carried to the fixing device 28. The sheet is heated by the fixing roller 30 while it is nipped by the fixing roller 30 and the pressure roller 32, so that the toner on the sheet is fused by heat and thereby fixed to the surface of the sheet. Then, the sheet to which the toner has been fixed is discharged to the paper discharge tray 34 via the carrying roller 36 and the discharge roller 38.

Next, the operation of the fixing device 28 will be described below.

When the power supply of the laser-beam printer is turned on, a given voltage is applied to the heating element 42 so that it generates high-temperature heat. The heat generated by the heating element 42 is transmitted to the whole of the heat conductive member 44. Since the thermal conductivity of the heat conductive member 44 is high, the temperature of the heat conductive member 44 at a portion at which it is in contact with the fixing roller 30, reaches substantially the temperature of the heating element 42 in a short time. Since the fixing roller 30 is thin and has a relatively low heat capacity, the portion of the fixing roller 30 in contact with the heat conductive member 44, i.e. the nip 40 of the fixing roller 30, can be heated to a predetermined temperature in a short time. Therefore, it is possible to decrease the time for the temperature of the nip 49 of the fixing roller 30 to reach a temperature suitable for the fixing (150° to 200° C.) after the voltage is applied to the heating element 42.

Since the heat conductive member 44 is kept in contact with the fixing roller 30 only at and around the nip 40, the temperature of the fixing roller 30 at a portion other than the nip 40 is lower than the temperature of the nip 40. When the fixing roller 30 rotates, the portion of the fixing roller 30 which has contacted the heat conductive member 44, moves away from the heat conductive member 44. Since the heat capacity of the fixing roller 30 is low, the temperature of the portion other than the nip 40 of the fixing roller 30 decreases due to heat radiation.

The sheet carried to the fixing device 28 is nipped at a portion at which the fixing roller 30 is pressed by the pressure roller 32, i.e. at the nip 40. Since the pressure roller 32 is pressing the fixing roller 30, the elastic member formed on the peripheral surface of the pressure roller 32 is deformed, so that the area of the contact portion at which the fixing roller 30 is in contact with the pressure roller 32, i.e. the area of the nip 40, increases. When a flexible sheet is introduced into the fixing device 28, it comes into contact with the fixing roller 30 at and around the nip 40, and the toner on the sheet is fused by the heat of the nip 40 of the fixing roller 30. As the fixing roller 30 rotates, the portion of the sheet at which the toner has been fused by heat moves from the nip 40 of the fixing roller to a portion neighboring the nip 40. At this time, the sheet is in contact with the portion neighboring the nip 40 of the fixing roller 30. Since the temperature of the portion neighboring the nip 40 is lower than the temperature of the nip 40, the temperature of the toner fused by heat decreases, so that the toner is fixed to the sheet. Therefore, since it is possible to prevent the toner being fused from adhering to the portion neighboring the nip 40 of the fixing roller 30, it is possible to prevent offset.

When the fixing roller 30 further rotates, the sheet is intended to be removed from the portion neighboring the nip 40 of the fixing roller 30. At this time, since the toner has been adhered to the sheet, the adhesive strength of the toner has been sufficiently decreased. Therefore, the sheet can be easily removed from the fixing roller 30, so that it is possible to prevent the sheet from being wound onto the fixing roller 30 and thereby prevent jamming of the sheet.

As mentioned above, according to this embodiment, the time necessary to heat the fixing roller 30 can be decreased without increase of heating value of the heating element 42, so that it is possible to prevent a temperature increase within the apparatus, such as a laser-beam printer. It is also possible to prevent the demand current to the heating element 42 from increasing. Furthermore, since the toner is fixed to the sheet when the sheet is removed from the fixing roller 30, it is difficult for the toner to adhere to the fixing roller 30, so that it is possible to prevent offset. At this time, since the adhesive strength of the toner on the sheet is decreased, the sheet can be easily removed from the fixing roller 30, so that it is possible to prevent jamming of the sheet.

Figure 3B:
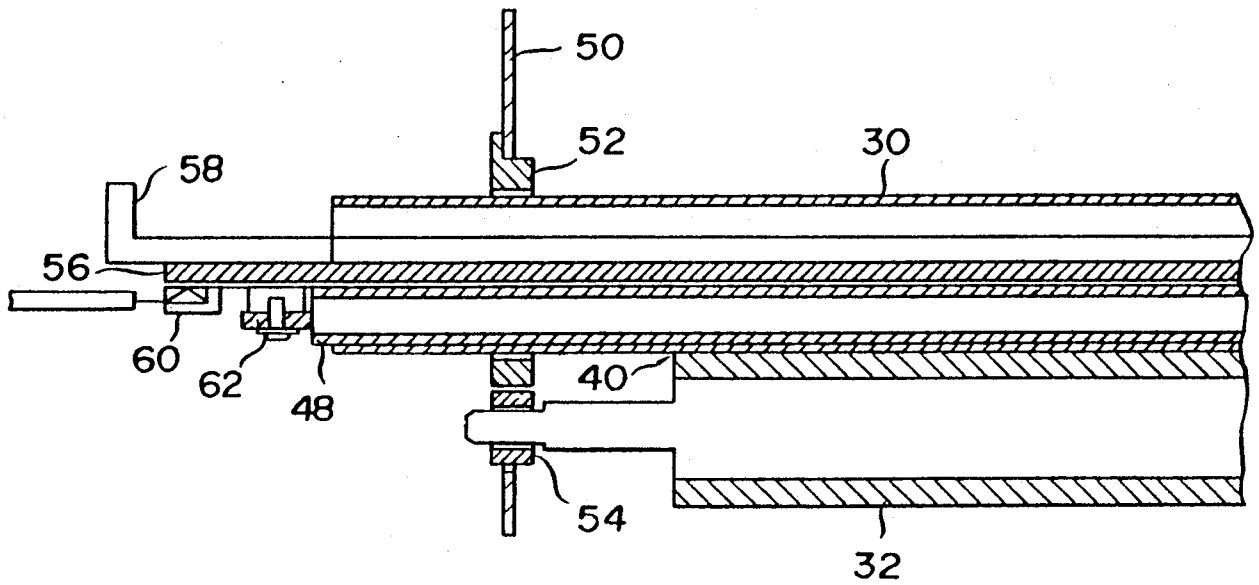
Figure 3A:
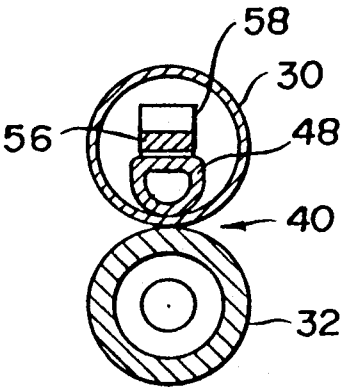

FIGS. 3(A) and 3(B) show the second preferred embodiment of an image fixing device, according to the present invention.

In this embodiment, the image fixing device 28 is substantially the same as that of the first preferred embodiment except that a heat conductive member 48 having a shape different to that of the heat conductive member 44 is substituted therefor. A pair of frame plates 50 are so arranged as to be opposite to each other and are fixed to the casing 10 of the laser-beam printer (only one frame plate is shown in FIG. 3(B)). The respective frame plates 50 are provided with bearings 52 and 54. The fixing roller 30 is rotatably supported on the bearing 52, and the pressure roller 32 is rotatably supported on the bearing 54 so as to be allowed to rotate while pressing the fixing roller 30.

The fixing roller 30 houses therein a heating element 56, a supporting member 58 and the heat conductive member 48. The supporting member 58 is composed of an elongated rod, and is secured to the frame of the laser-beam printer. The heating element 56 is composed of an elongated strip of a resistance material so as to produce heat of a high temperature when voltage is applied thereto, and is secured to the lower surface of the supporting member 58. The heating element 56 is provided with terminals 60 on both ends thereof, so that a given voltage is applied to the heating element 56 via the terminals 60. The heat conductive member 48 is composed of a hollow cylindrical member having a high thermal conductivity. Both ends of the heat conductive member 48 are secured to the heating element 56 by means of screws 62. In this embodiment, the heating device can provide same advantages as that of the first preferred embodiment.

Figure 4:
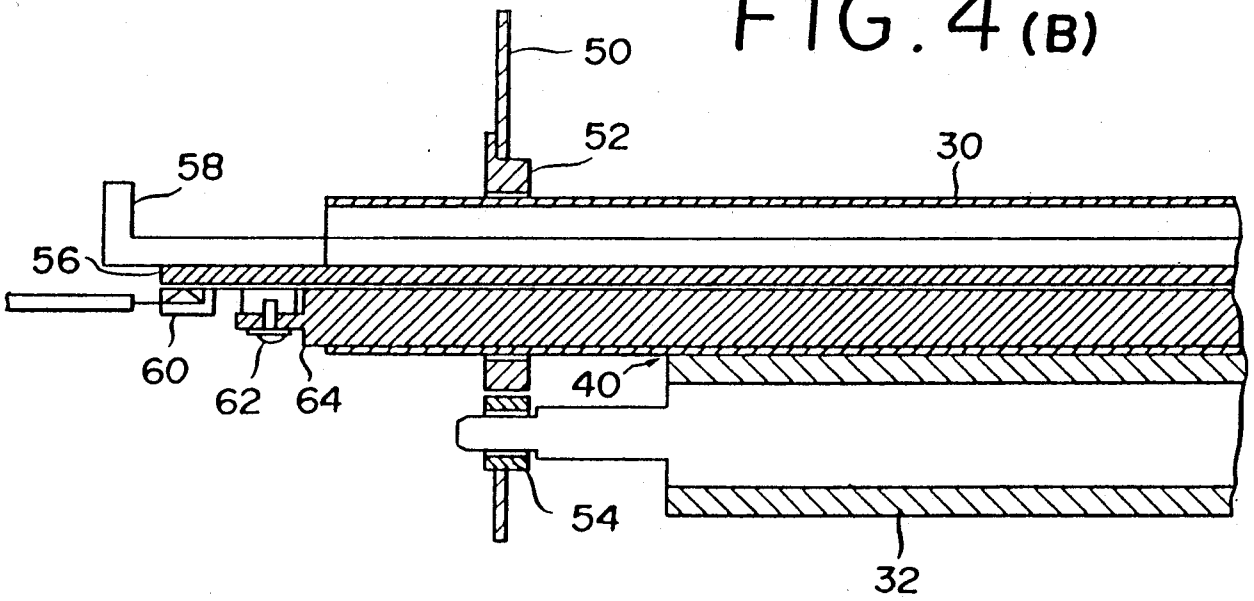
Figure 4:
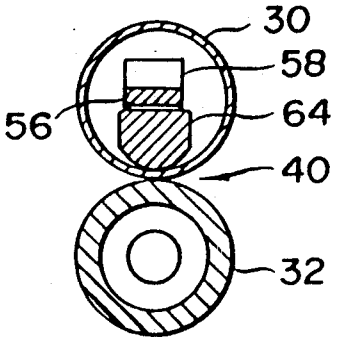

FIGS. 4(A) and 4(B) show the third preferred embodiment of an image fixing device, according to the present invention.

In this embodiment, the image fixing device 28 is substantially the same as that of the second preferred embodiment, except that a heat conductive member 64 which is not hollow is substituted for the heat conductive member 48.

Figure 5B:
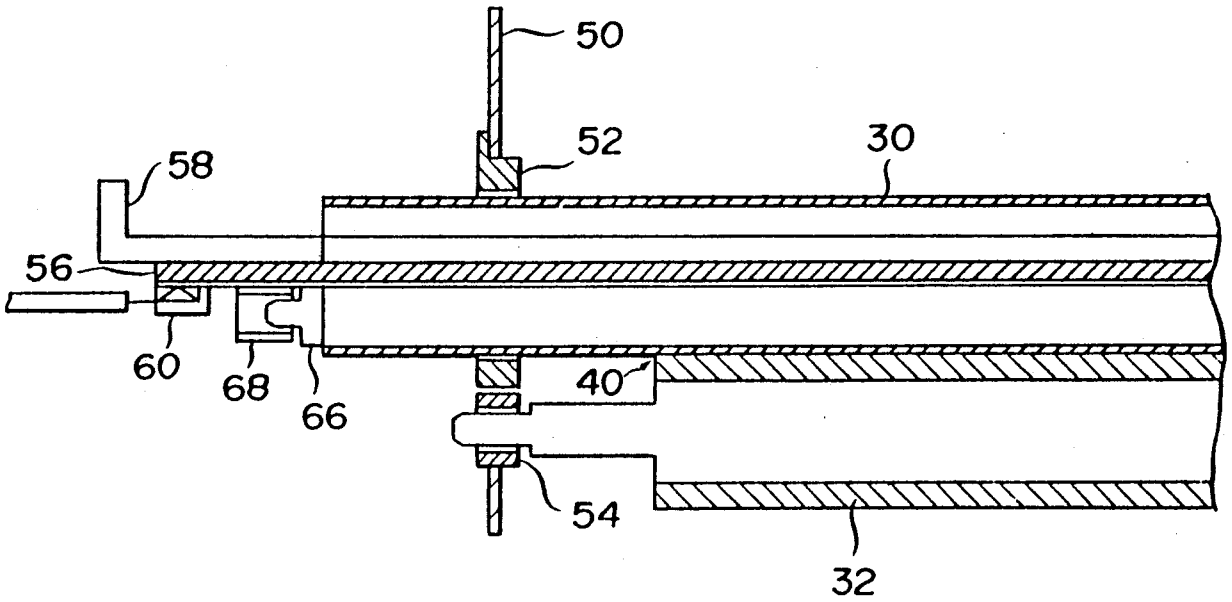
Figure 5A:
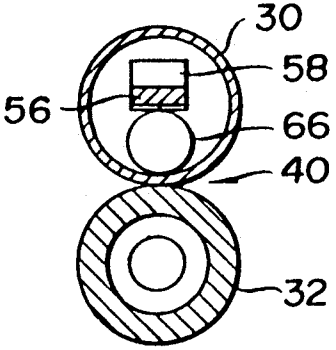

FIGS. 5(A) and 5(B) show the fourth preferred embodiment of an image fixing device, according to the present invention.

In this embodiment, the image fixing device 28 is substantially the same as that of the third preferred embodiment, except that a heat conductive member 66 having a shape different from that of the heat conductive member 64 is substituted therefor. The heat conductive member 66 is composed of a cylindrical roller, and both ends thereof are rotatably supported on bearings 68 which are secured to the supporting member 58. The lower portion of the heat conductive member 66 is in contact with the inner wall of the fixing roller 30, and the upper portion thereof is in contact with the heating element 56. In accordance with the rotation of the fixing roller 30, the heat conductive member 66 rotates in a reverse direction to the rotational direction of the fixing roller 30 while contacting with the inner wall of the fixing roller 30, and the upper portion of the heat conductive member 66 slides on the heating element 56.

Figure 6B:
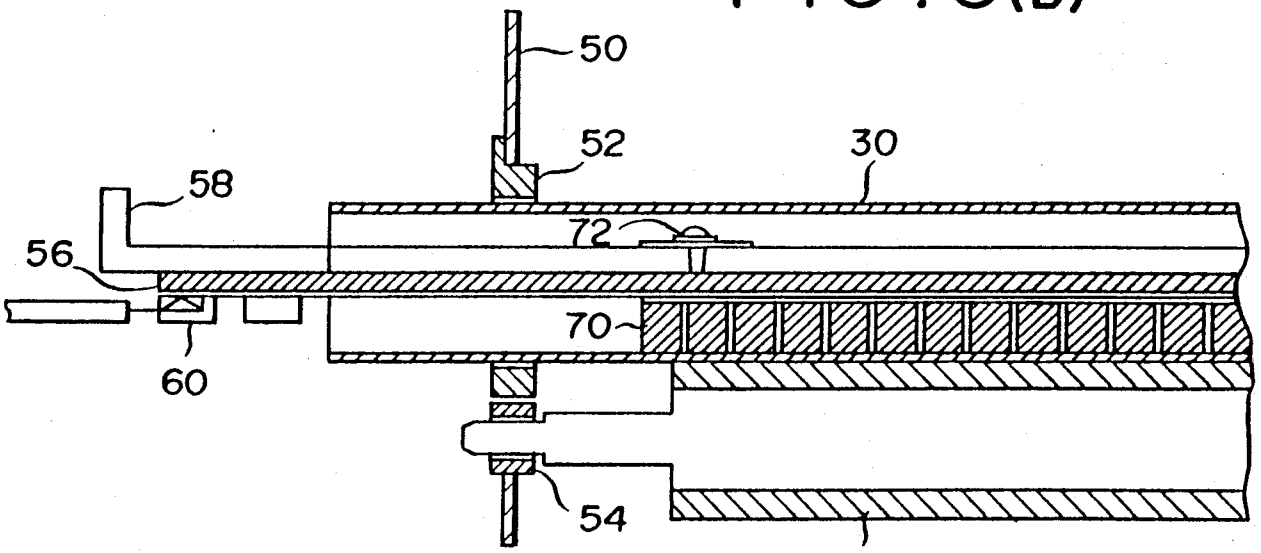
Figure 6A:
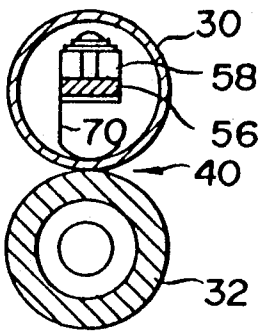

FIGS. 6(A) and 6(B) show the fifth preferred embodiment of an image fixing device, according to the present invention.

In this embodiment, the image fixing device 28 is substantially the same as that of the fourth preferred embodiment, except that a heat conductive member 70 is substituted for the heat conductive member 66. As can be clearly seen from FIG. 6(B), the heat conductive member 70 has a plurality of cutoffs so as to have a comb-shaped cross-section. The heat conductive member 70 is secured to the supporting member 58 by means of screws 72. As can be clearly seen from FIG. 6(A),the respective portions divided by the cutoffs have curved lower end portions which are tightly kept in contact with the inner wall of the fixing roller 30. When the fixing roller 30 rotates, the respective curved lower end portions slide on the inner wall of the fixing roller 30.

If the heat conductive member 70 is not provided with the cutoffs, the length of the portion of the heat conductive member 70 which is continuously brought into contact with the inner wall of the fixing roller 30, is long. For that reason, when the manufacturing accuracy of the heat conductive member 70 is insufficient, it is difficult to evenly bring the heat conductive member 70 into contact with the inner wall of the fixing roller 30. In this embodiment, since the heat conductive member 70 has a plurality of cutoffs which brings the divided lower portions of the heat conductive member 70 into contact with the inner wall of the fixing roller 30, these portions tend to evenly contact the inner wall thereof. Therefore, it is possible to positively transmit heat from the heat conductive member 70 to the fixing roller 30, so that it is possible to further decrease the time necessary to heat the fixing roller 30. In addition, since high manufacturing accuracy of the heat conductive member 70 is not required, there is the advantage in that it can be easily manufactured.

Figure 7B:
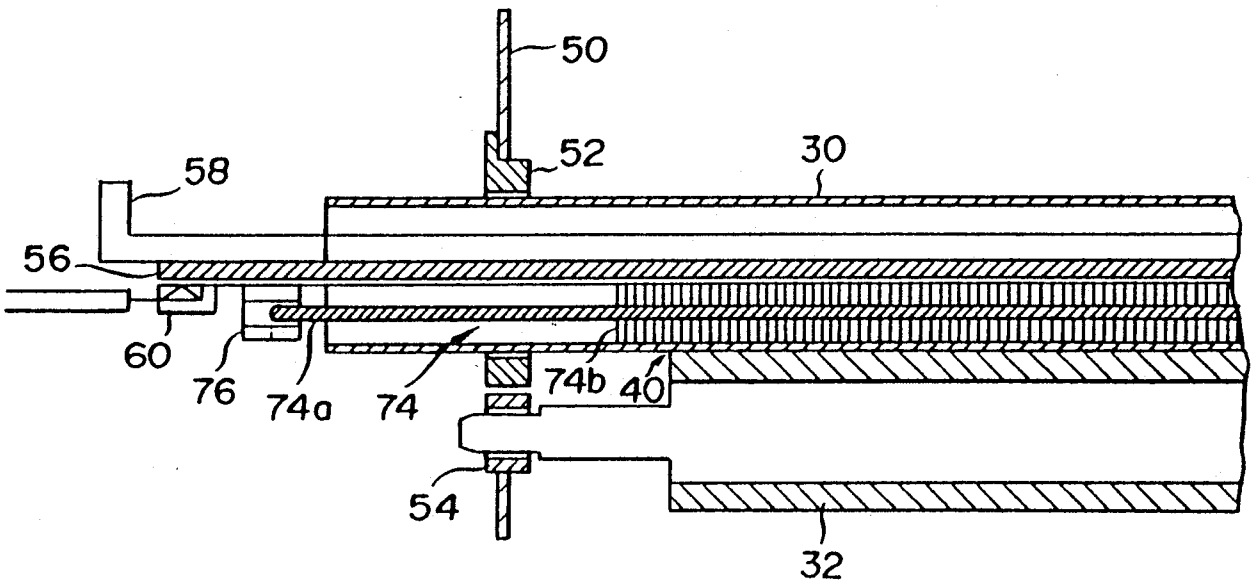
Figure 7A:
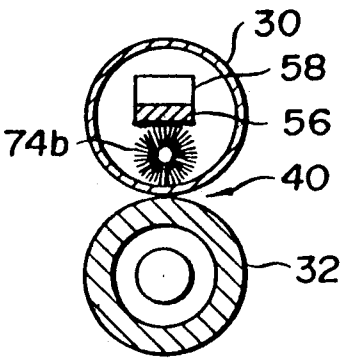

FIGS. 7(A) and 7(B) show the sixth preferred embodiment of an image fixing device, according to the present invention.

In this embodiment, the image fixing device 28 is substantially the same as that of the fifth preferred embodiment, except that a heat conductive member 74 is substituted for the heat conductive member 70. The heat conductive member 47 comprises an elongated shaft **74*a*, and a heat conductive brush 74*b* having a plurality of bristles radially extending from the shaft 74*a*. Both ends of the shaft 74*a* are rotatably supported on bearings 76 which are secured to the supporting member 58. The brush 74*b* is kept in contact with the heating element 56 and the inner wall of the fixing roller 30. In accordance with the rotation of the fixing roller 30, the heat conductive member 74 rotates in the reverse direction to the rotational direction of the fixing roller 30 while contacting the inner wall of the fixing roller 30, and slides on the heating element 56. In this embodiment, there is the advantage in that the heat conductive member 74 can be securely kept in contact with the inner wall of the fixing roller 30**.

Figure 8B:
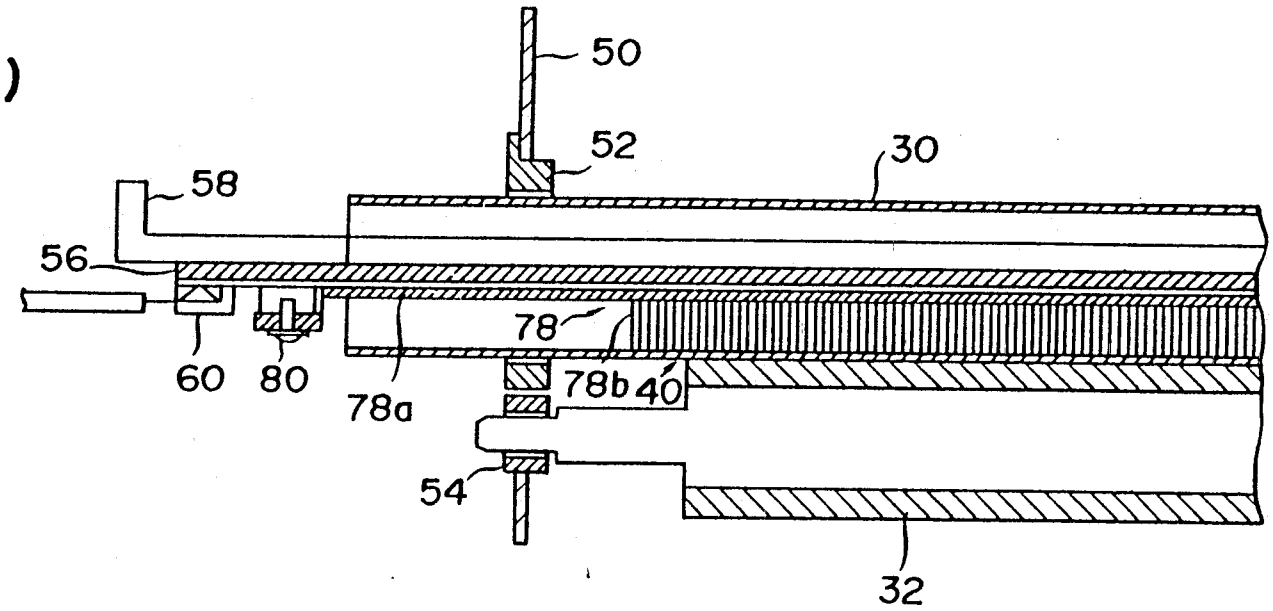
Figure 8A:
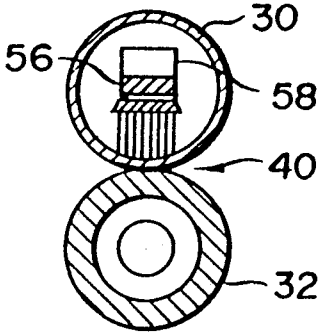

FIGS. 8(A) and 8(B) show the seventh preferred embodiment of an image fixing device, according to the present invention.

In this embodiment, the image fixing device 28 is substantially the same as that of the sixth preferred embodiment, except that a heat conductive member 78 is substituted for the heat conductive member 74. The heat conductive member 78 comprises a heat conductive plate **78*a*, and a heat conductive brush 78*b* having a plurality of bristles. The heat conductive plate 78*a* is secured to the supporting member 58 by means of screws 80 so as to press the heating element 56. The heat conductive brush 78*b* extends downwards from the lower surface of the heat conductive plate 78*a* so that the lower ends thereof are kept in contact with the inner wall of the fixing roller 30**.

Figure 9B:
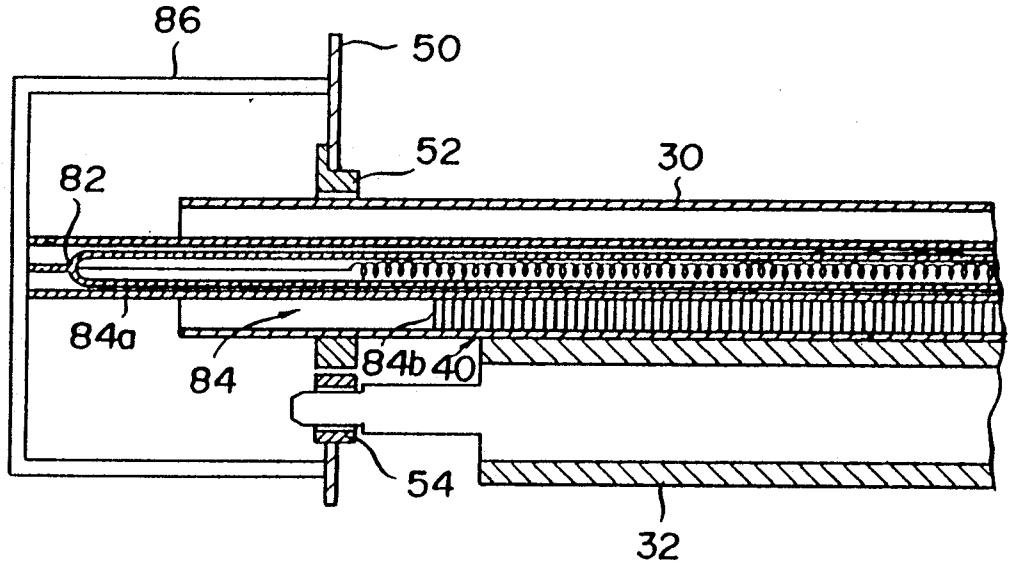
Figure 9A:
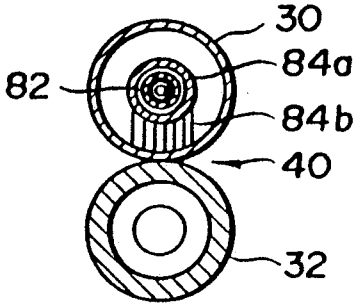

FIGS. 9(A) and 9(B) show the eighth preferred embodiment of an image fixing device, according to the present invention.

In this embodiment, the image fixing device 28 is substantially the same as that of the seventh preferred embodiment, except that a heating element 82 of an elongated halogen lamp and a heat conductive member 84 are respectively substituted for the heating element 78 and the heat conductive member 80. The heat conductive member 84 comprises a hollow cylinder **84*a* of a heat conductive material, and a heat conductive brush 84*b* having a plurality of bristles. Both ends of the hollow cylinder 84*a* are secured to frames 86. The heat conductive brush 84*b* extends from the hollow cylinder 84*a* so that the lower ends thereof are kept in contact with the inner wall of the fixing roller 30. The heating element 82 is housed within the heat conductive member 84, and both ends thereof are secured to the frames 86**.

Figure 10B:
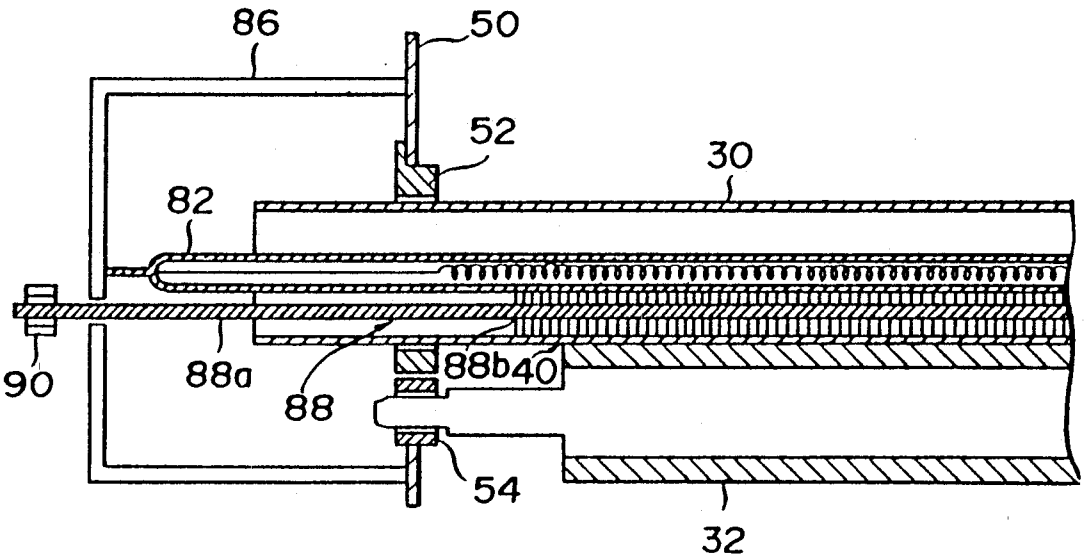
Figure 10A:
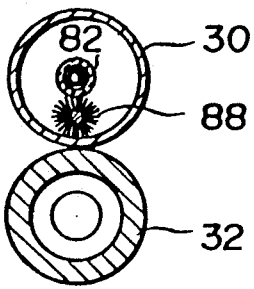

FIGS. 10(A) and 10(B) show the ninth preferred embodiment of an image fixing device, according to the present invention.

In this embodiment, the image fixing device 28 is substantially the same as that of the eighth preferred embodiment, except that a heat conductive member 88 is substituted for the heat conductive member 84. The heat conductive member 88 comprises a heat conductive rod 88*a* and a heat conductive brush 88*b* having a plurality of bristles. Both ends of the heat conductive rod 88*a* are rotatably supported on bearings 90.

Figure 11B:
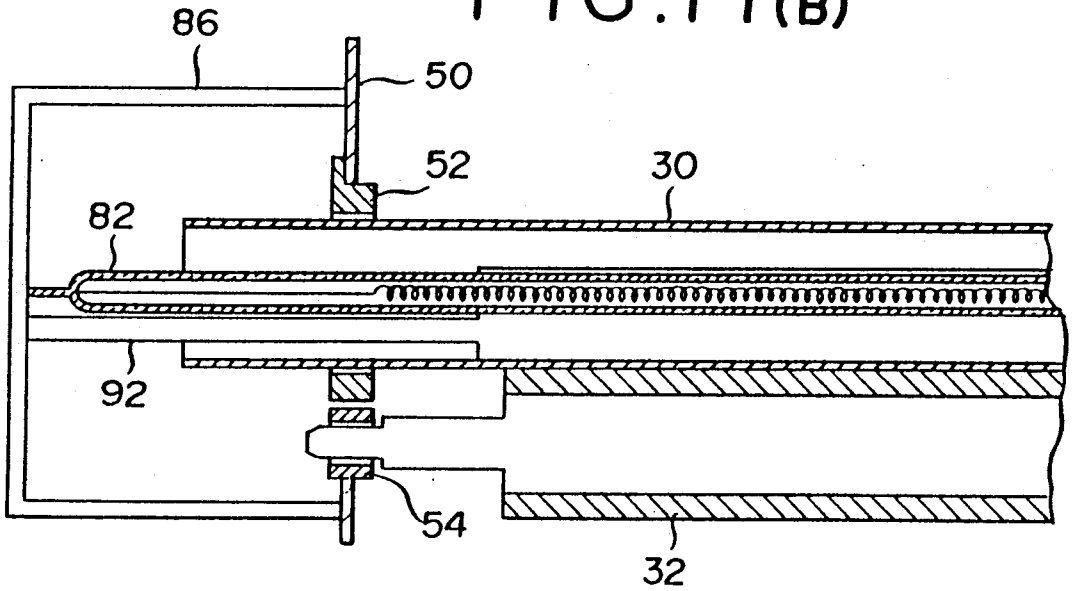
Figure 11A:
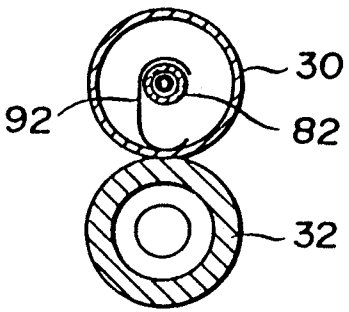

FIGS. 11(A) and 11(B) show the tenth preferred embodiment of an image fixing device, according to the present invention.

In this embodiment, the image fixing device 28 is substantially the same as that of the ninth preferred embodiment, except that a heat conductive member 92 is substituted for the heat conductive member 88. The heat conductive member 92 is composed of a curved, heat conductive plate, and both ends thereof are secured to the frame 86. As can be clearly from FIG. 11(A), the upper curved portion of the heat conductive member 92 is arranged to surround the heating element 82 without contact therewith, so that heat produced by the heating element 82 is transmitted to the heat conductive member 92 by radiation. The lower curved portion of the heat conductive member 92 is kept in contact with the inner surface of the fixing roller 30 so as to be capable of sliding thereon.

According to the aforementioned first to tenth preferred embodiments, it is possible to decrease the time necessary for the heating of the fixing roller, to prevent the offset, and to allow the sheet from being easily removed from the fixing roller.

Figure 12B:
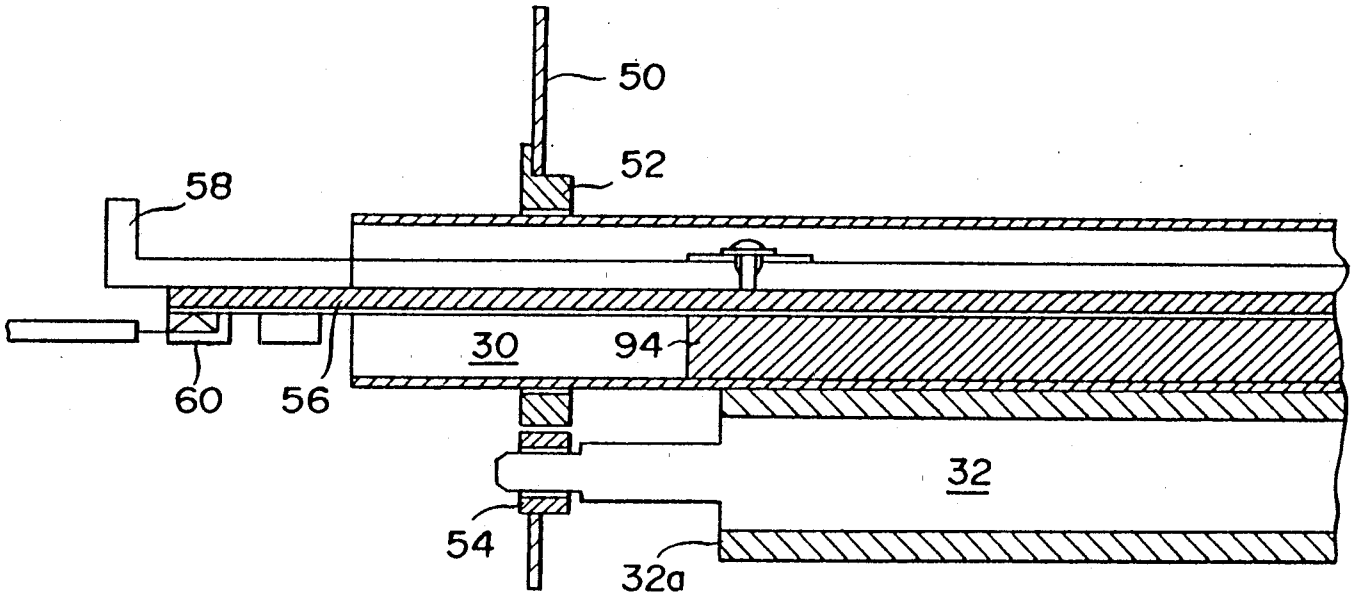
Figure 12A:
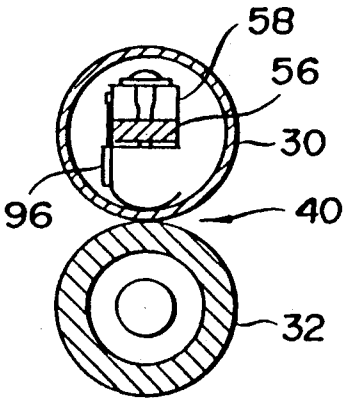

FIGS. 12(A) and 12(B) show the eleventh preferred embodiment of an image fixing device, according to the present invention.

In this embodiment, the image fixing device 28 is substantially the same as that of the second preferred embodiment, except that a heat conductive member 94 is substituted for the heat conductive member 48, and that a temperature detector 96 is provided in the fixing roller 30. As can be clearly seen from FIG. 12(A), the upper end of the heat conductive member 94 is supported on the supporting member 58, and the lower end thereof is curved. The curved portion of the heat conductive member 94 is kept in contact with the inner wall of the fixing roller 30 at a portion corresponding to the nip 40 (a portion at which the fixing roller 30 is in contact with the pressure roller 32). When the fixing roller 30 rotates, the curved portion of the heat conductive member 94 slides on the inner wall of the fixing roller 30.

The temperature detector 96, such as a thermistor, is secured to the heat conductive member 94 to detect the temperature thereof. The temperature detector 96 is connected to a control unit (not shown) so that the voltage (a detection signal) output from the temperature detector 96 is transmitted to the control unit.

The control unit may be, for example, an operational amplifier or a microcomputer to carry out a usual PID control. That is, the variation of the detected temperature is divided into proportional components, integral components and differential components, and the respective components are multiplied by a given gain to determine the voltage to be applied to the heating element 56. Furthermore, the voltage applied to the heating element 56 may be a pulse, and the duty ratio of the pulse may be varied.

Figures 13A, 13B:
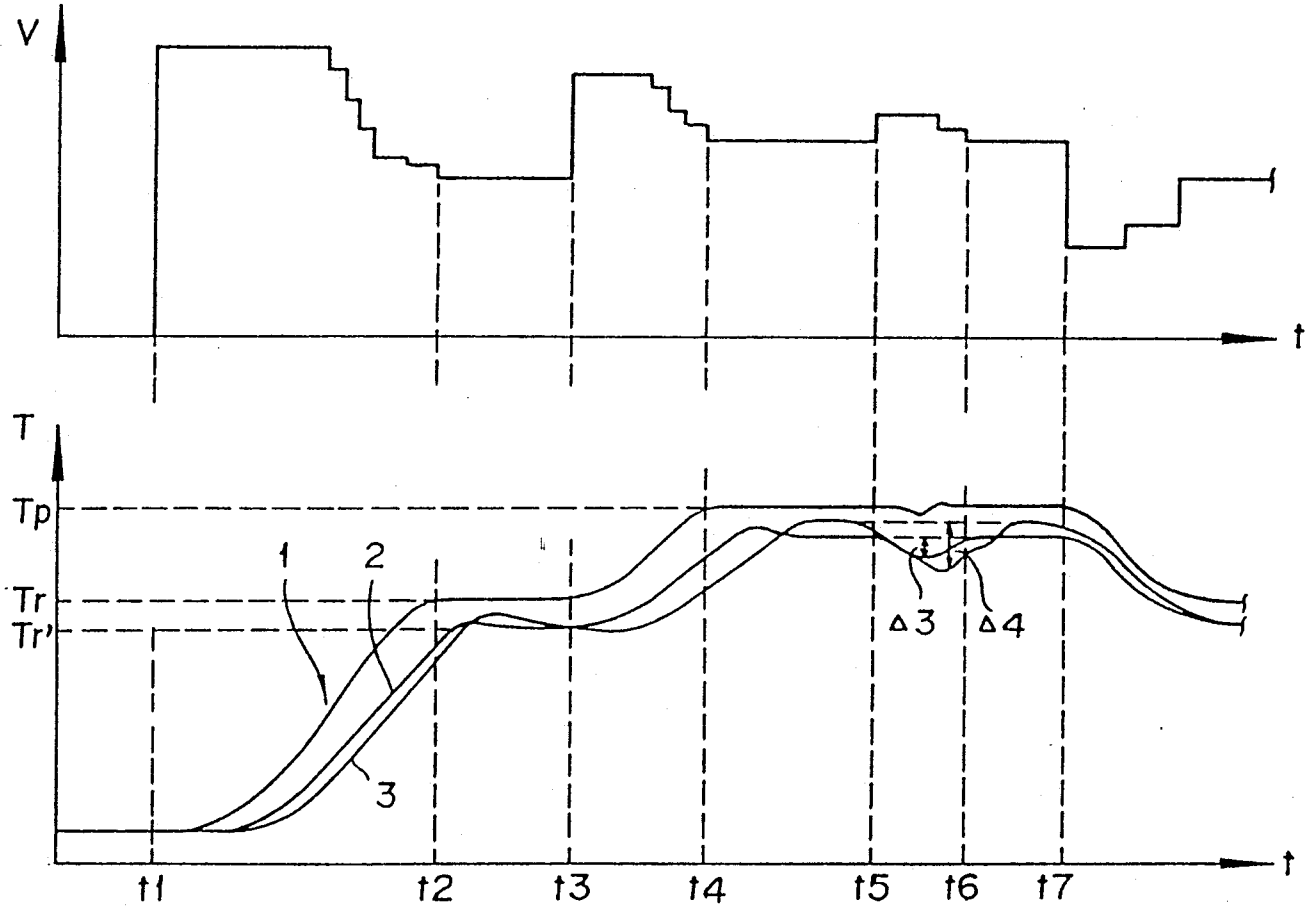
FIGS. 13(A) and 13(B) are graphs which respectively show the variation of voltage applied to a heating element, and the variations of temperatures of a heat conductive member and of a fixing roller at the nip.

Referring to FIGS. 13(A) and 13(B), the operation of the fixing device 28 shown in FIGS. 12(A) and 12(B) will be described below.

FIG. 13(A) is a graph showing the variation of the voltage applied to the heating element 56, and FIG. 13(B) is a graph showing the temperature variations of the heat conductive member 94 and of the fixing roller 30 at the nip 40. In FIG. 13(B), curved line 1 shows the variation of the temperature of the heat conductive member 94, curved line 2 shows the variation of the temperature of the fixing roller 30 at the nip 40 in this embodiment, and curved line 3 shows the variation of the temperature of the fixing roller at the nip in a conventional fixing device. In the conventional fixing device, the temperature detector is arranged in the heating element.

First, it is assumed that the power supply of the laser beam printer is turned on at time t1. At the same time, a target temperature controlled by the control unit is set to be a target temperature Tr at a stand-by time. For example, the controlled target temperature Tr is set to be 150° C. This target temperature Tr at the stand-by time is the controlled target temperature of the heat conductive member 94 when the laser-beam printer is in a stand-by condition, and this is set to be lower temperature than a target temperature Tp in the fixing operation (for example, 200° C.). At a time when the power supply is turned on, the temperature of the heat conductive member 94 detected by the temperature detector 96 is substantially equal to atmospheric temperature, which is far lower than the target temperature Tr at the stand-by time. The temperature detector 96 detects the temperature of the heat conductive member 94 and produces a detection signal to the control unit. The control unit determines the voltage which is to be applied to the heating element 56 in accordance with the difference between the temperature defined by the detection signal and the target temperature Tr at the stand-by time. When the determined voltage is applied to the heating element 56, the heating element 56 produces heat. As the temperature of the heat conductive member 94 detected by the temperature detector 96 approaches the target temperature Tr at the stand-by time, the voltage applied to the heating element 56 decreases. As a result, at time t2, the temperature of the heat conductive member 94 reaches the target temperature Tr at the stand-by time.

On the other hand, the nip 40 of the fixing roller 30 is heated by the heat conductive member 94, so that the temperature of the nip 40 of the fixing roller 30 reaches the temperature of the heat conductive member 94. That is, the temperature of the nip 40 of the fixing roller 30 reaches a temperature Tr′ approximate to the target temperature Tr at the stand-by time. Since the temperature of the nip 40 of the fixing roller 30 is not directly controlled by a control loop, and since the fixing roller 30 has a given heat capacity and heat resistance, there is a temperature difference between the nip 40 of the fixing roller 30 and the heat conductive member 94.

In conventional fixing devices, the temperature of the nip of the fixing roller is maintained at the target temperature at the stand-by time by controlling the heating element in a similar manner to that of this embodiment. However, while the temperature detector 96 is provided on the heat conductive member 94 in this embodiment, the temperature detector is provided on the heating element in a conventional fixing device so that only the temperature of the heating element is controlled.

Therefore, in conventional fixing devices, both of the temperatures of the heat conductive member and the nip of the fixing roller can not be controlled by the control loop. The heat capacity and the heat resistance from the heating element to the nip of the fixing roller, includes the heat capacity and the heat resistance of the heat conductive member, so that these value become even greater. Therefore, when compared with the conventional fixing devices in this embodiment, the temperature of the nip 40 of the fixing roller 30 can be maintained in a range approximate to the target temperature Tr' of the nip 40 at the stand-by time.

When the laser-beam printer starts a printing operation, the target temperature controlled by the control unit is switched from the target temperature Tr at the stand-by time to the target temperature Tp at the fixing time (at time t3). Since the temperature of the heat conductive member 94 is lower than the target temperature Tp at the fixing time, a higher voltage is applied to the heating element 56. Thereafter, at time t4, the temperature of the heat conductive member 94 reaches the target temperature Tp at the fixing time. As a result, heat is transmitted from the heat conductive member 94 to the nip 40 of the fixing roller 30, so that the temperature of the nip 40 of the fixing roller 30 reaches a value approximating the target temperature Tp at the fixing time. Compared with the conventional fixing devices in this case, the temperature of the nip 40 of the fixing roller 30 can be maintained at a value approximating the target temperature Tp at the fixing roller 30.

Assuming that an outside disturbance, such as the variation of surrounding temperature, is applied to the fixing roller 40 between time t5 and time t6, the nip 40 of the fixing roller 30 is affected by the outside disturbance, and its temperature varies. The temperature of the heat conductive member 94 is also affected by the variation of the temperature of the fixing roller 30 and is inclined to vary. However, since the temperature of the heat conductive member 94 is controlled so as to reach the target temperature Tp at the fixing time, the variation of the temperature of the heat conductive member 94 is restrained. Due to heat transfer from the heat conductive member 94, the temperature of the fixing roller 30 reaches a value approximating the temperature of the heat conductive member 94, so that the temperature variation Δ T3 of the fixing roller 30 can be maintained within a given range. Now, assuming that the temperature variation of the fixing roller in the conventional fixing devices is Δ T4, the temperature variation Δ T3 will be compared with the temperature variation Δ T4. In the conventional fixing devices, neither the temperature of the fixing roller nor the heat conductive member is controlled by the control loop. Therefore, when the temperature of the nip of the fixing roller varies due to an outside disturbance, the temperature of the heat conductive member also varies under the influence of the temperature variation of the fixing roller, so that the temperature variation Δ T4 of the nip of the fixing roller becomes greater than the temperature variation Δ T3. That is, in this embodiment, it is possible to decrease the temperature variation Δ T3 of the nip 40 of the fixing roller 30 to less than that of the conventional fixing devices.

When the laser-beam printer moves to stand-by condition at time t7, the target temperature controlled by the control unit is set to change from the target temperature Tp at fixing time to the target temperature Tr at stand-by time, so that the temperature of the heat conductive member 50 is controlled to be the target temperature Tr at stand-by time.

As mentioned above, according to this embodiment, the temperature difference between the temperature of the nip 40 of the fixing roller 30 and the controlled target temperature can be decreased, and the temperature variation due to outside disturbance can be also decreased. Therefore, it is possible to prevent the temperature of the nip 40 of the fixing roller 30 from varying from a temperature which is suitable for the fixing, so that it is possible to prevent the imperfect fixing and offset.

Furthermore, if the heat conductive member 94 is formed of a material having a higher heat conductivity, the heat capacity and the heat resistance of the heat conductive member 94 can be decreased, so that the heat transfer time from the heat conductive member 94 to the nip 40 of the fixing roller 30 can be decreased, thereby the control response can be enhanced. When the control responsibility is enhanced, it is possible to decrease the time for the temperature of the fixing roller 30 to reach a temperature suitable for fixing after the power supply has been turned on. Therefore, it is possible to decrease the time for the temperature of the nip 40 of the fixing roller 30 to reach a temperature suitable for fixing, without increasing the heating value of the heating element 56. Consequently, it is possible to prevent the demand current from increasing and to restrain the temperature increase within the laser beam printer.

Figure 14B:
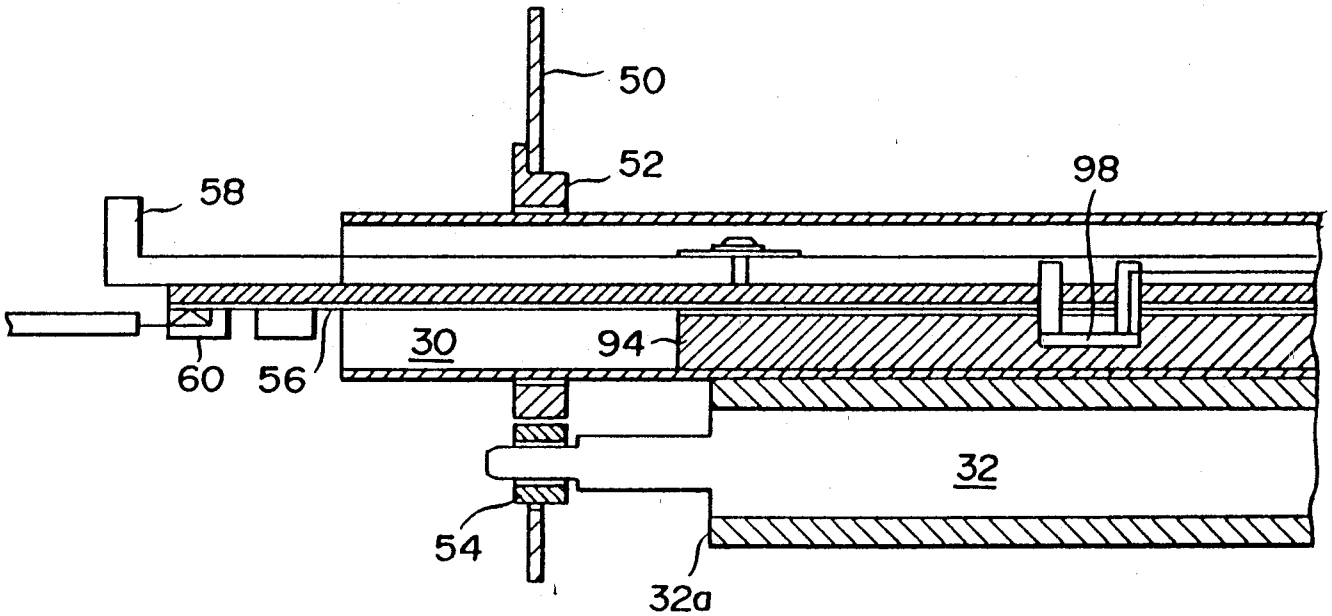
FIGS. 14(A) and 14(B), and 15(A) and 15(B) are, respectively, laterally and longitudinally sectional views of the twelfth and thirteenth preferred embodiments of an image fixing device, according to the present invention, taken along lines perpendicular and parallel to the longitudinal axis of a fixing roller, respectively.
Figure 14A:
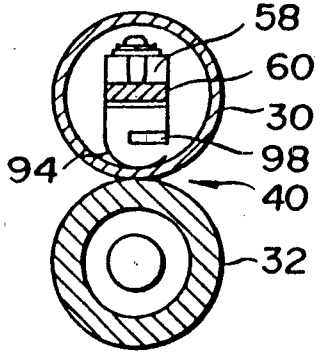

FIGS. 14(A) and 14(B) show the twelfth preferred embodiment of an image fixing device, according to the present invention.

In this embodiment, the image fixing device 28 is substantially the same as that of the eleventh preferred embodiment, except that a temperature detector 98 substituted for the temperature detector 96 is arranged between the heating element 56 and the inner wall of the fixing roller 30 at a location corresponding to the nip 40, so as to detect the temperature of air layer between the heating element 56 and the inner wall of the fixing roller 40. Heat produced by the heating element 56 passes through the heat conductive member 94 and is transmitted to the inner wall of the fixing roller 30 through the air layer. The temperature detector 56 detects the temperature of the air layer, so that the temperature of the air layer is controlled to be substantially constant.

Figure 15B:
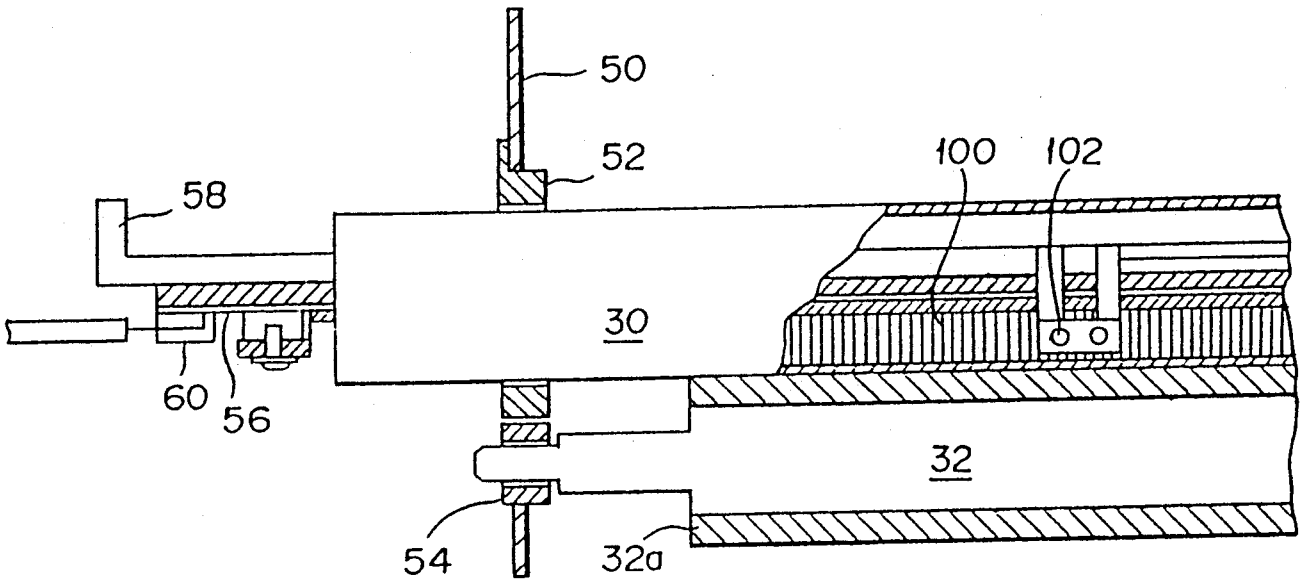
Figure 15A:
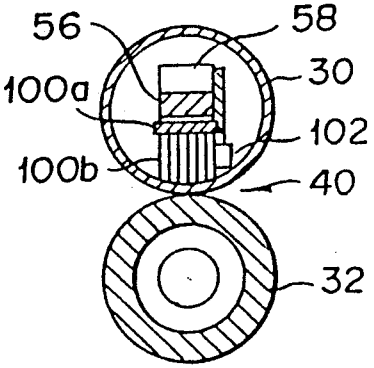

FIGS. 15(A) and 15(B) show the thirteenth preferred embodiment of an image fixing device, according to the present invention.

In this embodiment, the image fixing device 28 is substantially the same as the eleventh preferred embodiment, except that a heat conductive member 100 is substituted for the heat conductive member 94. The heat conductive member 100 comprises an elongated, heat conductive strip 100*a* and a heat conductive brush 100*b*. The brush 100*b* is so arranged as to positively contact the inner wall of the fixing roller 30. Similar to the eleventh preferred embodiment, a temperature detector 102 is secured to the heat conductive member 100 to detect temperature thereof. In this embodiment, since the heat resistance from the heating element 56 to the heat conductive member 100 is small, the deviation and variation of the temperature of the nip 40 of the fixing roller can be further decreased, so that it is possible to effectively prevent imperfect fixing and offset.

Figure 16B:
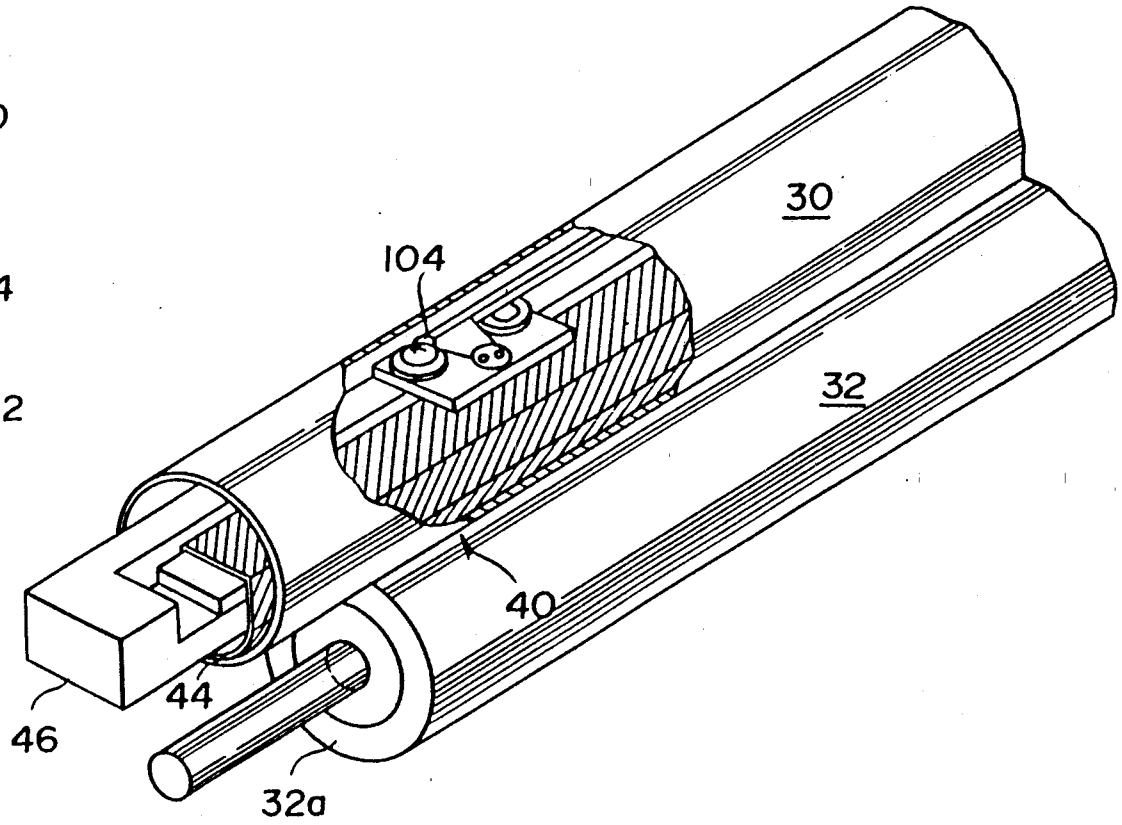
FIGS. 16(A) and 16(B) are respectively a laterally sectional view and a partially cross-sectioned, perspective view of the fourteenth preferred embodiment of an image fixing device, according to the present invention, which sectional view is taken along a line perpendicular to the longitudinal axis of a fixing roller.
Figure 16A:
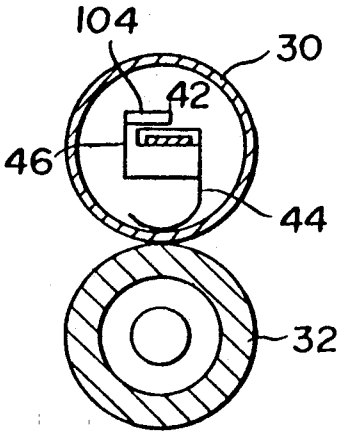

FIGS. 16(A) and 16(B) show the fourteenth preferred embodiment of an image fixing device, according to the present invention.

In this embodiment, the image fixing device 28 is substantially the same as that of the first preferred embodiment, except that a temperature detector 104 which has the same functions as those of the eleventh preferred embodiment, is provided in the fixing roller 30. The heat conductive member 44 comprises a flat upper portion which is secured to the upper surface of the heating element 42, an intermediate portion which is kept in contact with the supporting member 46, and a curved lower portion which is kept in contact with the inner wall of the fixing roller 30. The temperature detector 104 is secured to the supporting member 46 to detect the temperature thereof. Since the supporting member 46 is kept in contact with both the heating element 42 and the heat conductive member 44, the temperature of the supporting member 46 is substantially equal to the temperature of the heat conductive member 44. That is, the temperature of the supporting member 46 detected by the temperature detector 104 is equivalent to the temperature of the heat conductive member 44. Therefore, in this embodiment, it is possible to provide the same advantage as that of the eleventh preferred embodiment in which the temperature detector 96 is secured to the heat conductive member 94.

According to the aforementioned eleventh to fourteenth preferred embodiments, it is possible to prevent imperfect fixing and offset by decreasing the temperature variation of the fixing roller.

Figure 17:
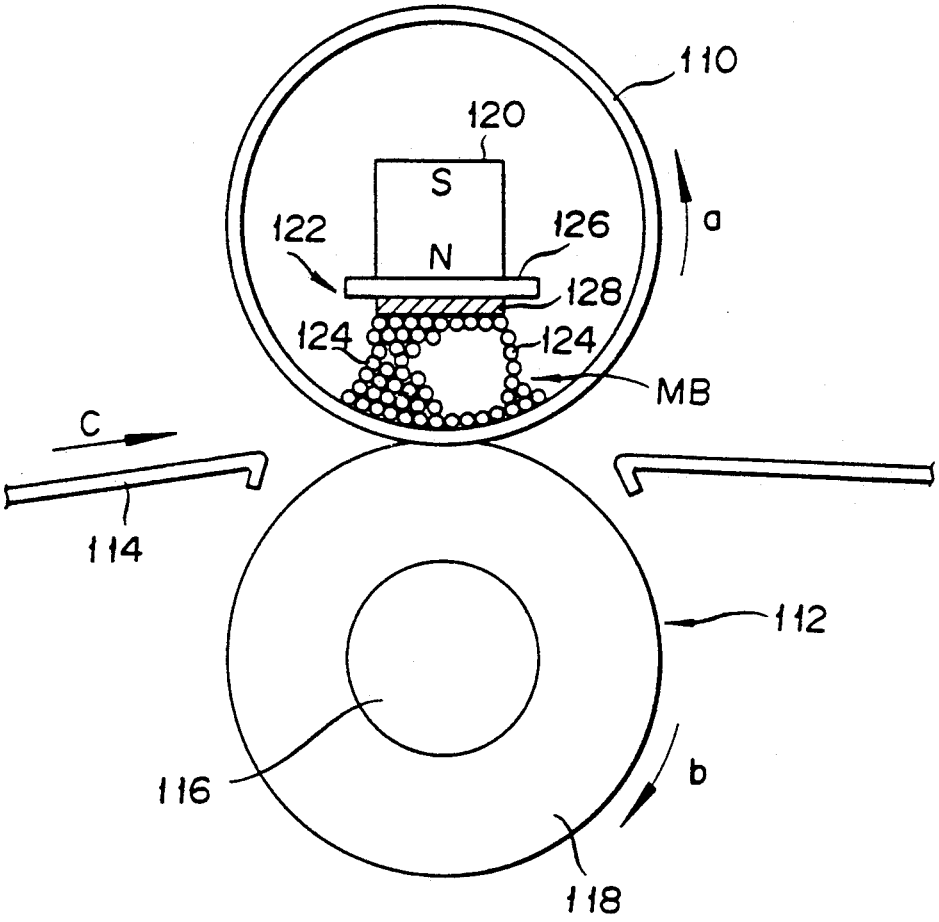
FIG. 17 is a schematic plan view of the fifteenth preferred embodiment of an image fixing device, according to the present invention.

FIG. 17 shows the fifteenth preferred embodiment of an image fixing device, according to the present invention.

The image fixing device 28 comprises a fixing roller 110, a pressure roller 112 and a recording paper guide 114. The fixing roller 110 is composed of a hollow cylindrical roller made of stainless steel (24.0 mm in diameter; 0.5 mm in thickness), which is rotatable in the direction of arrow a. The pressure roller 112 is so arranged as to press the fixing roller 110, and to be rotatable in the direction of arrow b. The recording paper guide 114 serves to guide a recording paper. The recording paper to which no toner is fixed is carried on the recording paper guide 114 in a direction of the arrow c, and then it is introduced into a contact portion between the fixing roller 110 and the pressure roller 112. As the recording paper passes through the contact portion, the fixing is carried out by heat and pressure. The pressure roller 112 comprises a metallic core 116 made of stainless steel (12 mm in diameter), and a mold releasing layer 118 made of silicone rubber (4 mm in thickness).

The fixing roller 110 houses therein a magnet 120, a heating source 122 and a plurality of metallic beads 124 made of a magnetic material, such as stainless steel (1.0 mm in diameter). The heating source 122 comprises a ceramic substrate 126 and a resistance heating member 128 baked thereon. The magnet 120 is mounted on the surface of the ceramic substrate 126 opposite to the surface on which the resistance heating member 127 is baked, so that the magnet 120 forms a magnetic field in a downwards direction in the drawing. The metallic beads 124 are drawn to the heating source 122 by the magnet 120, so as to form a magnetic brush MB between the heating source 122 and the fixing roller 110. The end of the magnetic brush MB is kept in contact with the inner wall of the fixing roller 110 to transmit heat produced by the heating source 122 to the fixing roller 110.

In this embodiment, due to the field of the magnet 120 the metallic beads 124 remain magnetic, and it is possible to prevent the metallic beads 124 from diffusing in the direction of arrow a as a result of the rotation of the fixing roller 110. In addition, since the metallic beads 124 are formed of a high heat conductive material, it is possible to effectively transmit heat from the heating source 122 to the contact portion between the fixing roller 110 and the pressure roller 112, so as to ensure sufficient fixing when the paper passes therethrough. Furthermore, at the contact portion where the magnetic brush MB is kept in contact with the fixing roller 110, the metallic beads 124 roll in accordance with the rotation of the fixing roller 110, thereby making it possible to decrease friction between the magnetic brush MB and the fixing roller 110.

As mentioned above, according to this embodiment, it is possible to stably and quietly carry out fixing by local heating without torque variations and sliding noises.

Figure 18:
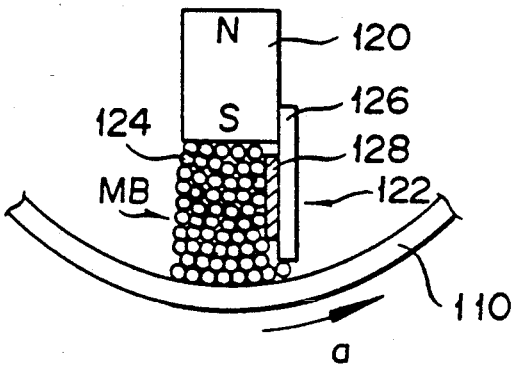
FIGS. 18 to 20 are schematic plan views partially showing a fixing roller in the sixteenth to eighteenth preferred embodiment of an image fixing device, according to the present invention.

FIG. 18 shows the sixteenth preferred embodiment of an image fixing device, according to the present invention.

In this embodiment, the image fixing device 28 is substantially the same as that of the fifteenth preferred embodiment, except that the heating source 122 is arranged on a side of the magnetic brush MB formed of the metallic beads 124, which is downstream relative to the direction of rotation of the fixing roller 110. That is, the heating source 122 is positioned on a side of the magnetic brush MB such that deformation of the brush due to rotation of the fixing roller 110 is avoided. In this embodiment, the metallic beads 124 of the magnetic brush MB are intended to move in the direction of rotation of the fixing roller 110 while being regulated by the heating source 122. As a result, it is possible to enhance adhesion of the magnetic brush MB to the heating source 122, to more effectively transmit heat from the heating source 122 to the magnetic brush MB.

In the aforementioned fifteenth and sixteenth preferred embodiments, although metallic beads 124 are made of stainless steel, in accordance with the present invention they may be made of any other magnetic materials having a high heat conductivity.

Figure 19:
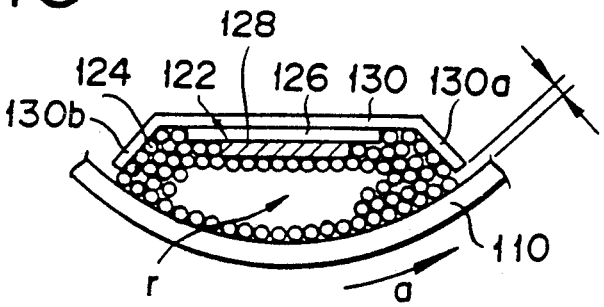

FIG. 19 shows the seventeenth preferred embodiment of an image fixing device, according to the present invention.

In this embodiment, a sheet metal 130 is housed within the fixing roller 110. The sheet metal 130 has on both ends thereof a pair of regulating plate **130*a* and 130*b* which are formed by bending the sheet metal 130. The ends of the regulating plates 130*a* and 130*b* face the inner wall of the fixing roller 110 upstream and downstream of the contact portion of the fixing roller 110 with the pressure roller 112, so as to form a chamber r within the fixing roller 110. In the chamber r, the heating source 122 and the metallic beads 124 made of aluminum (1 mm in diameter) are housed. The distances d between the ends of the regulating plates 130*a* and 130*b*, and the inner wall of the fixing roller 110 are smaller than the diameter of the metallic beads 124 so that dispersion of the metallic beads 124 is prevented. The chamber r extends over the whole length of the fixing roller 110 in the direction of the axis thereof, and both ends of the chamber r are covered with shielding members (not shown). Furthermore, the chamber r may be formed by the ceramic substrate 126 without the sheet metal 130**.

In this embodiment, there is the same advantage as that of the fifteenth preferred embodiment. In addition, since the regulating plates 130*a* and 130*b* prevent the diffusion of the metallic beads 124, the metallic beads 124 may also be made of non-magnetic material. In particular, when the metallic beads 124 are made of aluminum, it is possible to decrease the weight of the image fixing device 28.

Figure 20:
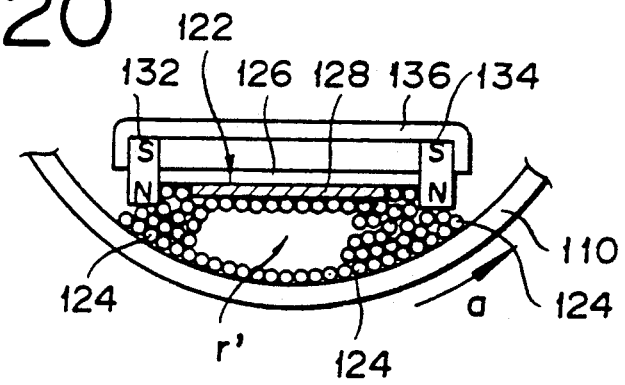

FIG. 20 shows the eighteenth preferred embodiment of an image fixing device, according to the present invention.

In this embodiment, a chamber r' for retaining therein the metallic beads 124 is formed by a pair of magnets 132 and 134. That is, the magnets 132 and 134 are supported on a sheet metal 136 and arranged at both ends of the heating source 122 so as to form a magnetic field toward the fixing roller 110. Gaps between the magnets 132 and 134 and the fixing roller 110 are shielded by the metallic beads 124 made of a magnetic material to form the chamber r'. The metallic beads 124 housed within the chamber r' may also be made of a non-magnetic material, such as aluminum (1.0 mm in diameter). The magnets 132 and 134 extend over the whole length of the fixing roller 110 in the direction of the axis thereof, and both ends of the magnets 132 and 134 are covered with shielding members (not shown).

Figure 21:
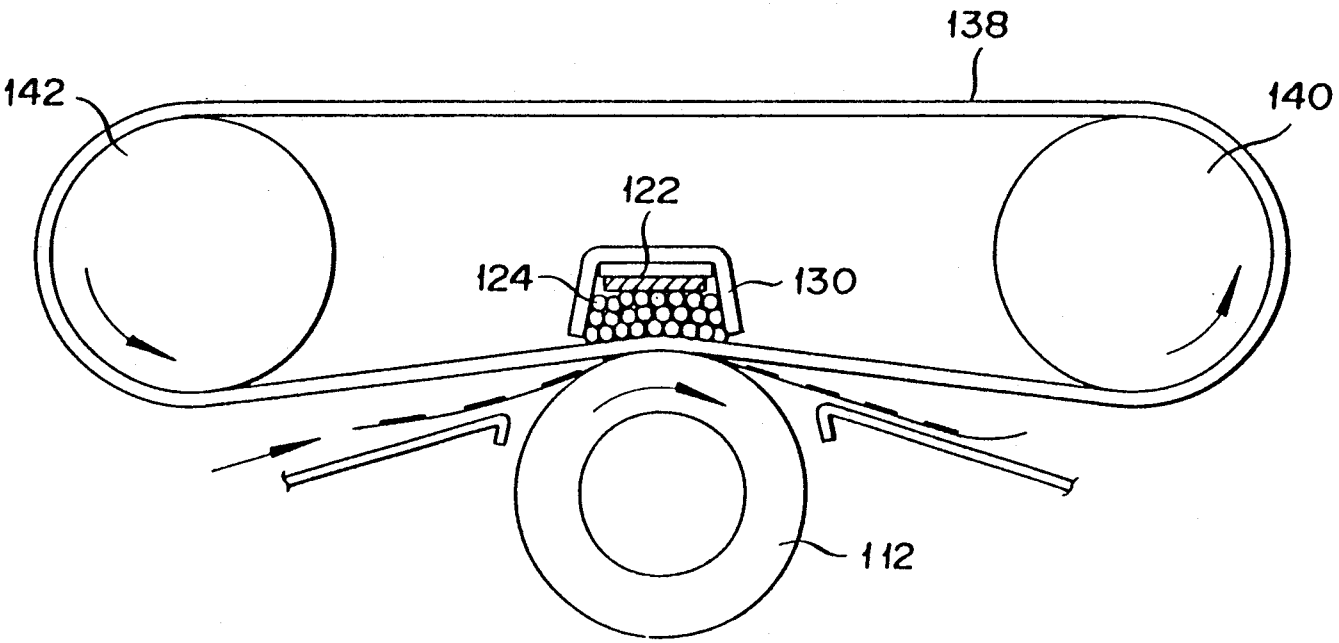
FIG. 21 is a schematic plan view of the nineteenth preferred embodiment of an image fixing device, according to the present invention.

FIG. 21 shows the nineteenth preferred embodiment of an image fixing device, according to the present invention.

In this embodiment, the image fixing device 28 is substantially the same as that of the seventeenth preferred embodiment, except that a fixing belt 138 of a heat resistance film having high heat conductivity is substituted for the fixing roller 110. The fixing belt 138 is wound onto a pair of rollers 140 and 142 which are separated from each other by a predetermined distance, and allowed to rotate in accordance with the rotation of the rollers 140 and 142. The fixing belt houses therein the heating source 122, the metallic beads 124 and the sheet metal 130. The metallic beads 124 are kept in contact with the fixing belt 138 to roll in accordance with the movement of the fixing belt 138, such that friction between the metallic beads 124 and the fixing belt 138 is decreased. Therefore, the abrasion of the fixing belt can be decreased to enhance the durability thereof.

In the aforementioned fifteenth to nineteenth preferred embodiments, the metallic beads 124 may be coated with a material, such as a fluororesin, to decrease the frictional coefficient of the metallic beads 124.

As mentioned above, according to the aforementioned fifteenth to nineteenth preferred embodiments, heat from the heating source is transmitted to heating means, such as the fixing roller or the fixing belt, through heat conductive means comprising a plurality of beads. Therefore, it is possible to decrease the friction between the heating means and the heat conductive means to enable stable and quiet fixing without torque variations and sliding noises. In addition, since the heat from the heating source is locally transmitted to the contact portion of the heating means by a pressure means, such as the pressure roller, it is possible to decrease the warm-up time of the image fixing device to decrease demand thereof. In a case where the metallic beads are magnetically retained by the magnet, between the heating source and the contact potion, it is possible to positively bring the heat conductive means into contact with the heating means to stably transmit heat thereto even if the distance between the heating source and the heating means varies due to an error in installation. Furthermore, when the metallic beads are retained by means of regulating plates between the heating source and the contact portion, it is possible to use a heat conductive means of a non-magnetic material with simple constructions.

Referring to FIGS. 22 to 25, the twentieth preferred embodiment of an image fixing device, according to the present invention, will be described below.

The image fixing device 28 comprises a fixing roller 150 (made of stainless; diameter 24 mm; thickness 0.3 mm; heat conductivity 16.3 W/m. °C.; specific heat 0.46 kJ/kg. °C.; density $7.8\times10^3$ kg/m$^3$) serving as a rotating body, a pressure roller 152 serving as a pressure body, a pair of guiding plates 154 and 156, and a removing or cleaning claw 158. The fixing roller 150 is designed to rotate in the direction of arrow a in FIG. 22 by means of a main motor M by which elements (not shown), such as a sensitizing body and a transfer roller, are also driven. The peripheral surface of the fixing roller 150 is coated with a fluororesin layer serving as a mold releasing layer. The pressure roller 152 is designed to rotate in the direction of arrow b in FIG. 22 in accordance with rotation of the fixing roller 150 while pressing the fixing roller 150. The pressure roller 152 comprises a metallic core 160 (made of stainless steel; 12 mm in diameter) and a mold releasing layer 162 (made of silicone rubber; thickness 4 mm) formed thereon. The pressure roller 152 presses the fixing roller 150 to form a nip n (3.6 mm in width tangential to the fixing roller 150). The guiding plate 154 serves to guide a recording paper to which a toner image has been transferred in a transferring section (not shows), and the guiding plate 156 serves to guide the recording paper to which the toner has been fixed. The guiding plate 154 has on one end thereof a paper sensor P for detecting the presence of a recording paper near the nip n. The cleaning claw 158 serves to prevent the recording paper to which the toner has been fixed, from being wound onto the fixing roller 150.

The fixing roller 150 houses therein a heating portion 164 which comprises a pivotal shaft 166 arranged concentrically with the fixing roller 150, a holder 168 secured to the pivotal shaft 166, a ceramic substrate 170 supported on the holder 168, a resistance heating element 172 baked on the ceramic substrate 170, and a heat conductive member 174 (made of aluminum; 3.6 mm in width) for transmitting heat energy produced by the resistance heating element 172 to the fixing roller 150. The heating portion 164 extends over the whole length of the fixing roller 150 in the direction of the longitudinal axis thereof. The heating portion 164 is designed to rotate around the rotation axis of the pivotal shaft 168 while pressing the fixing roller 150.

The pivotal shaft 168 of the heating portion 164 is connected to an oscillating portion 176 which comprises a lever 178, a solenoid 180 and a spring 182. That is, one end of the pivotal shaft 168 is connected to one end of the lever 178, the other end of which is provided with a pin 184. The pin 184 engages a flange 186 of the solenoid 180 which causes the lever 178 to move in the direction of arrow c in FIG. 22. The pin 184 also engages one end of the spring 182 for biasing the lever 178 in the direction of arrow c' in FIG. 22.

Figure 24:
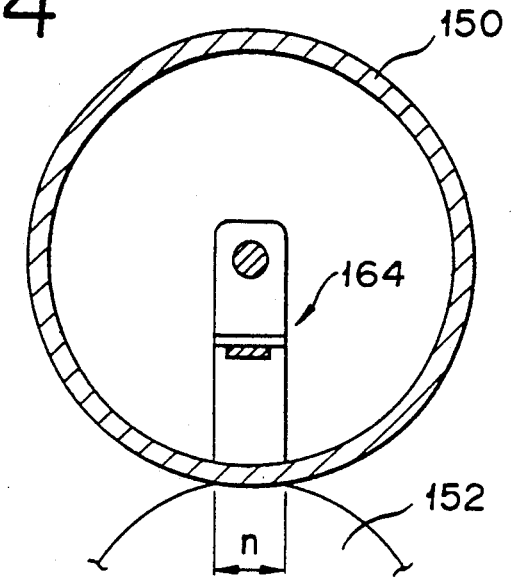
FIGS. 24 and 25 are sectional views showing positions of a heating portion in the image fixing device of FIG. 22 when a fixing roller is stopped and rotates, respectively.
Figure 25:
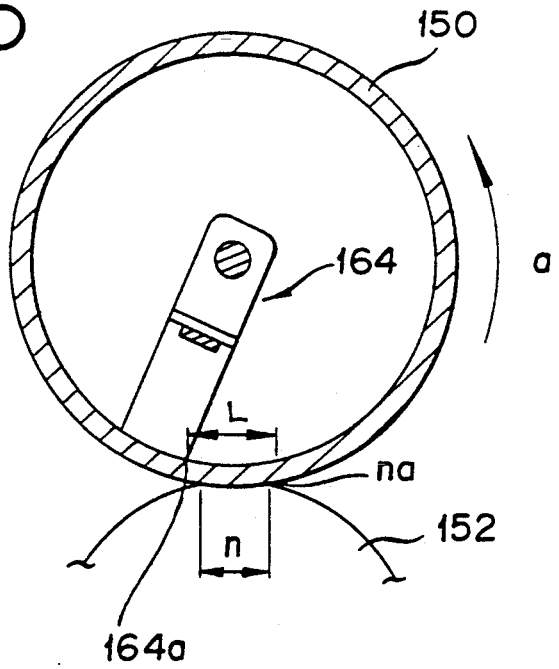

With this construction, when the fixing roller 150 and the pressure roller 152 are stopped, the heating portion 164 is positioned at the nip n as shown in FIG. 24. On the other hand, when the fixing roller 150 and the pressure roller 152 rotate, the heating portion 164 is moved so that the trailing edge 164*a* thereof is separated from the trailing edge na of the nip n by a distance L(mm) upstream relative to the direction of rotation of the heating roller 150, as shown in FIG. 25. The reason the heating portion 164 is moved by the distance L when the fixing roller 150 rotates, is as follows.

Figure 26:
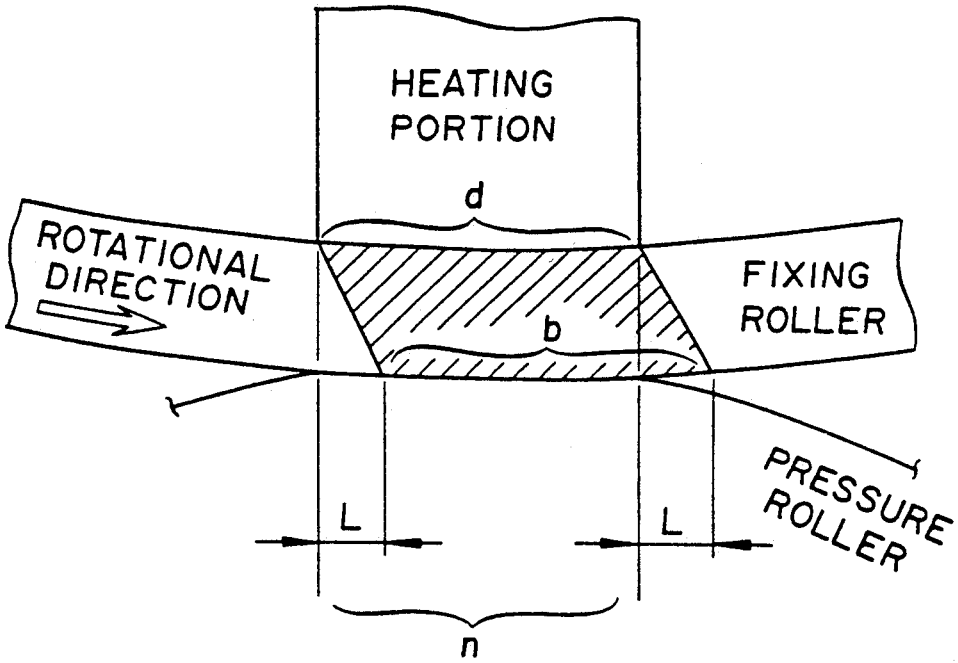
FIG. 26 is a schematic view showing heat transmission between the inner and outer surfaces of a fixing roller if a heating portion is not moved when the fixing roller rotates.

Since the fixing roller 150 has a given thickness, it takes a predetermined time $\tau$ until the heat energy transmitted to the inner wall of the fixing roller 150 is transmitted to the outer wall thereof. Assuming that the speed of movement of the outer wall of the fixing roller 150 is Vs(mm/s) when it rotates, the fixing roller 150 moves by $L=Vs\tau$ (mm) for the predetermined time $\tau$. Therefore, as shown in FIG. 26, if the heating portion 164 is positioned at a location corresponding to the nip when the fixing roller 150 rotates, the heat energy transmitted to a region a on the inner wall of the fixing roller 150 is not transmitted to a region corresponding to the nip n on the outer wall thereof, but it is transmitted to a region b separated from the nip n downstream relative to the direction of rotation of the fixing roller 150. For that reason, the heat energy transmitted to a region separated from the trailing edge of the nip n by a distance L can not be used for the fixing and is radiated to atmosphere, so that the temperature within the apparatus is needlessly increased.

Therefore, according to this embodiment, the heating portion 164 is moved by the distance L when the fixing roller 150 rotates. The distance L is set so that the heat energy transmitted to the inner wall of the fixing roller 150 from the heating portion 164 can be assuredly transmitted to the nip n without radiation thereof to a region other than the nip n, in accordance with the following manner.

First, since the temperature variation of the fixing roller 150 is dependent on time, the conduction of heat energy of the fixing roller 150 can be defined by the following equation which is well known as a differential equation of non-steady heat conduction in a solid.

$$(2T/2t)=(K/\rho c)\nabla^2 T \quad (1)$$

wherein K is heat conductivity (W/m. °C.), $\rho$ is density (J/kg. °C.) and c is specific heat (J/kg. °C.).

Figure 27:
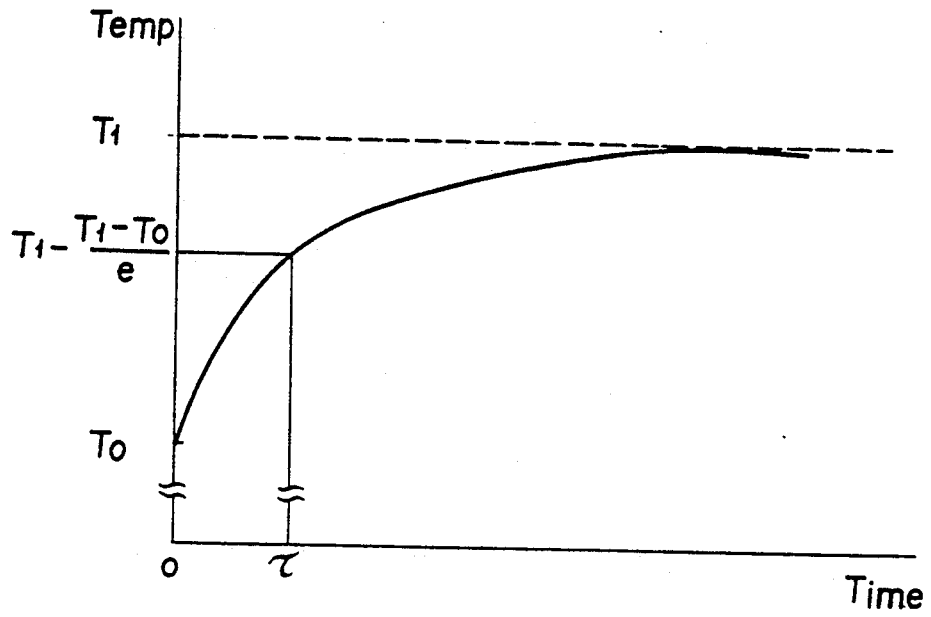
FIG. 27 is a graph showing the variation of non-steady temperature at an optional point.
Figure 28:
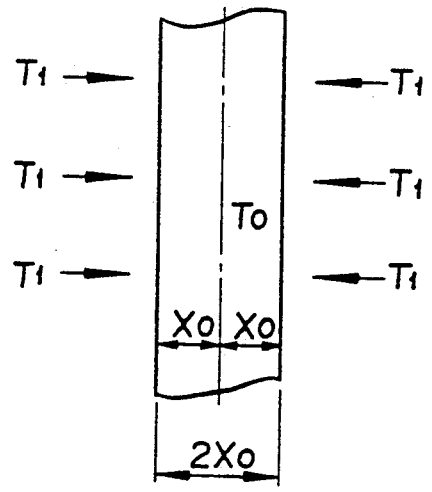
FIG. 28 is a schematic view showing an infinite plane of $2X_0$ in thickness.
Figure 29:
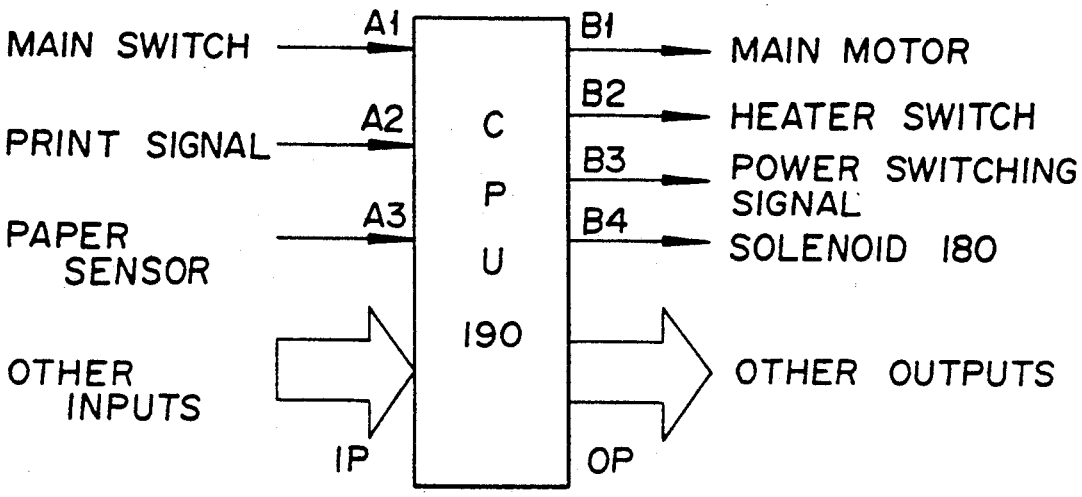
FIG. 29 is a block diagram of a control unit for controlling a heating portion of the image fixing device of FIG. 22.

In addition, it is well known that when a solid of an initial temperature $T_0$ is placed in a surrounding of a temperature $T_1$, the temperature variation at a position P in the solid is dependent on time, so that the temperature at the position P asymptotically approaches the temperature $T_1$ as time passes, as shown in FIG. 27. In FIG. 27, the temperature $T_1-(T_1-T_0)/e$ is a temperature versus time constant. It is assumed that the position P is in a steady state at a time corresponding to the aforementioned time constant, and that this time is defined as a relaxation time $\tau$. On the other hand, since the width of the heating portion 164 is far smaller than the diameter of the fixing roller 150 in this embodiment, the contact portion of the heating portion 164 with the inner wall of the fixing roller 150 can be considered as a plane. Therefore, as shown in FIG. 28, the heat conduction from the inner peripheral surface of the fixing roller 150 to the outer peripheral surface can be approximated by a non-steady heat conduction in an infinite plane of $2X_0$ in the thickness and $T_0$ of initial temperature. When the infinite plane is placed in a circumstance of the temperature $T_1$, the relaxation time $\tau$ can be defined by the following equation.

$$\tau=(2X_0/\pi h)^2 \quad (2)$$

wherein $h^2=K/\rho$ c is thermal diffusivity. In addition, the relaxation time when only one surface of the infinite plane of $X_0$ in thickness and $T_0$ of initial temperature is heated at the temperature of $T_1$, can be considered similar to equation (2) in view of the symmetric property of FIG. 28. The aforementioned equations (1) and (2) are cited from "Compact Physics Handbook" (Fuchiro Kobayashi and Tatsunari Hirose; published by Maruzen Co., Ltd.)

In view of the foregoing, in this embodiment, the fixing roller 150 is moved by a distance L(mm) obtained by the following equation, for a relaxation time $\tau$ in which the heat energy is transmitted from the heating portion 164 to the fixing roller 150.

$$L=Vs\tau=Vs(2X_0/\pi h)^2 \quad (3)$$

wherein Vs(mm/s) is the speed of movement of the fixing roller 150.

According to this embodiment, the trailing edge 164*a* of the heating portion is moved by the distance L(mm) upstream of the trailing edge na of the nip n, so that the heat energy transmitted from the trailing edge 164*a* of the heating portion 150 to the inner peripheral surface of the fixing roller 150 can be assuredly transmitted to the nip n without radiation to a portion other than the nip n.

In this embodiment, since $X_0=0.3$ (mm), c=0.46(kJ/kg. °C.), $\rho=7.8(\times 10^3$ kg/m$^3$), K=16.3(W/m. °C.) and Vs=50(mm/s), the distance L(mm) may be set to be greater than (0.4(mm). In this embodiment, L=1.0(mm) is selected in view of the manufacturing error of the fixing roller 150. When the distance L(mm) is set to be greater than a theoretical value, the heat energy is transmitted to the outer peripheral surface of the fixing roller 150 upstream of the nip n, and this heat energy can be used for fixing as preheating energy. Furthermore, it is necessary to set an optimum value of the distance L(mm) in accordance with the material, thickness and so forth of the fixing roller 150.

With this construction, the fixing device 28 is controlled by a CPU 190. Input ports A1 and A3 of the CPU 190 are respectively connected to a main switch MS and a paper sensor P, and a print signal PS is input from a host computer (not shown) to an input port A3. On the other hand, in order to control the image fixing device 28, output ports B1, B2 and B4 of the CPU 190 are respectively connected to a main motor M, a heater switch HS for switching the resistance heating element 172 ON and OFF, and the solenoid 180, and a power switching signal is output from an output port B3.

When the main switch MS is turned on, a signal for turning ON the heater switch HS is output from the output port B2, so that the resistant heating element 172 is heated, whereby the surface of the pressure roller 152 is heated at a location corresponding to the nip n via the heat conductive member 174 and the fixing roller 150. In this condition, the solenoid 180 is turned off, and the heating portion 164 is stopped by means of the regulating spring 182 at a position corresponding to the nip n.

Figure 22:
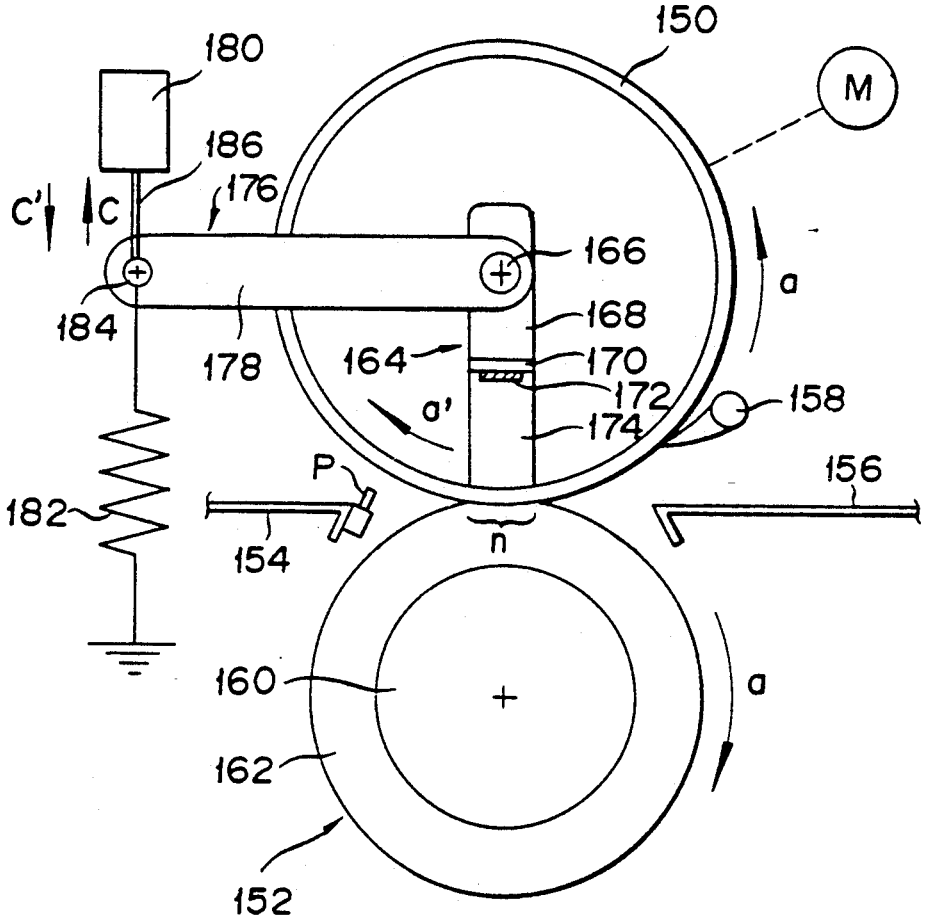
FIG. 22 is a schematic plan view of the twentieth preferred embodiment of an image fixing device, according to the present invention.
Figure 23:
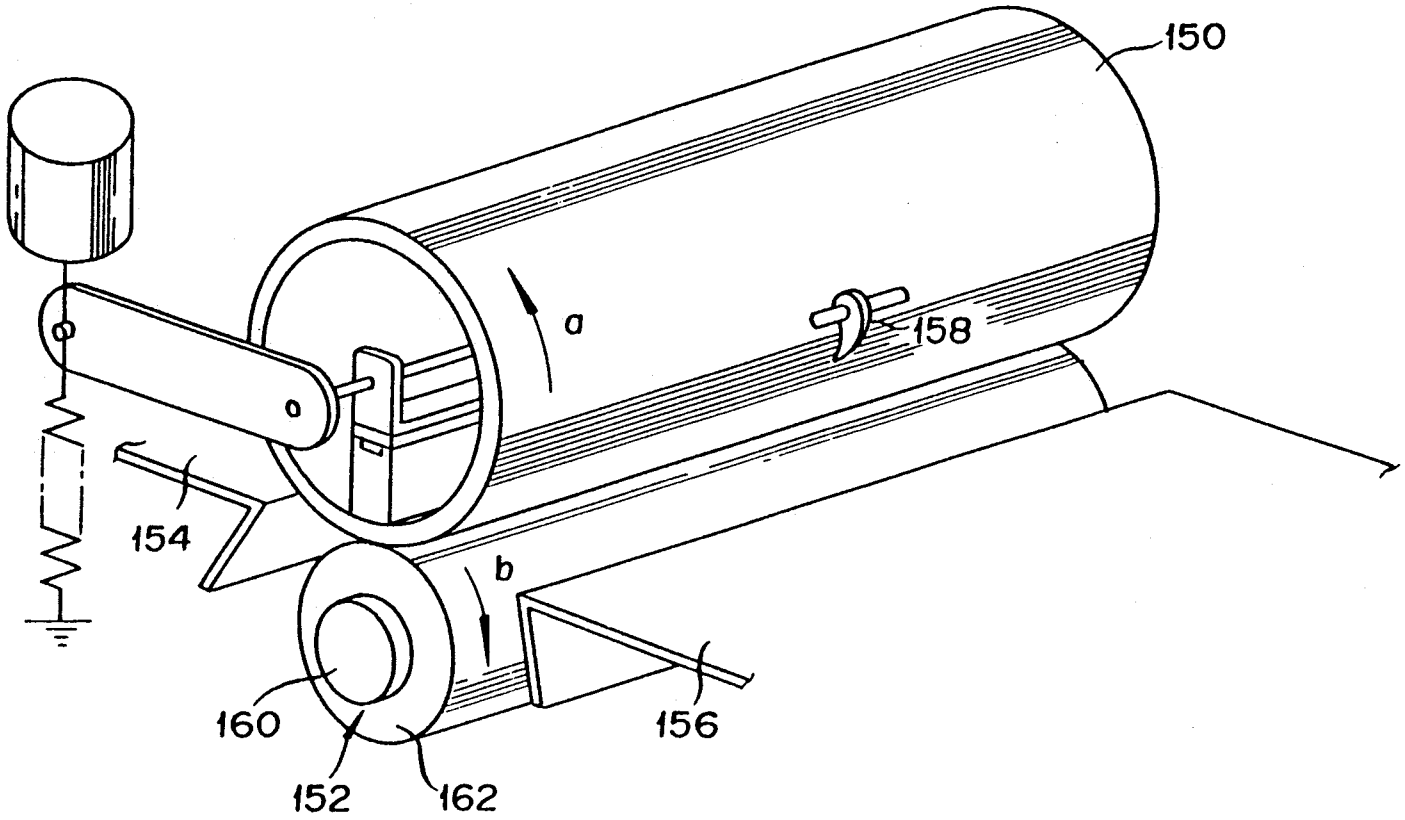
FIG. 23 is a perspective view of the image fixing device of FIG. 22.

When the print signal PS is input to the CPU 190, the main motor M is turned on, so that the fixing roller 150 rotates in the direction of arrow a in FIG. 22 while the solenoid 180 is turned on to move the pin 184 against the spring force of the regulating spring 182 in the direction of arrow c in FIG. 22. As a result, the heating portion 164 rotates around the rotating shaft 166 so that the trailing edge 164*a* of the heating portion 164 moves in the direction of arrow a' and is separated from the trailing edge na of the nip n by 1 mm upstream relative to the direction of rotation of the fixing roller 150.

Figure 30:
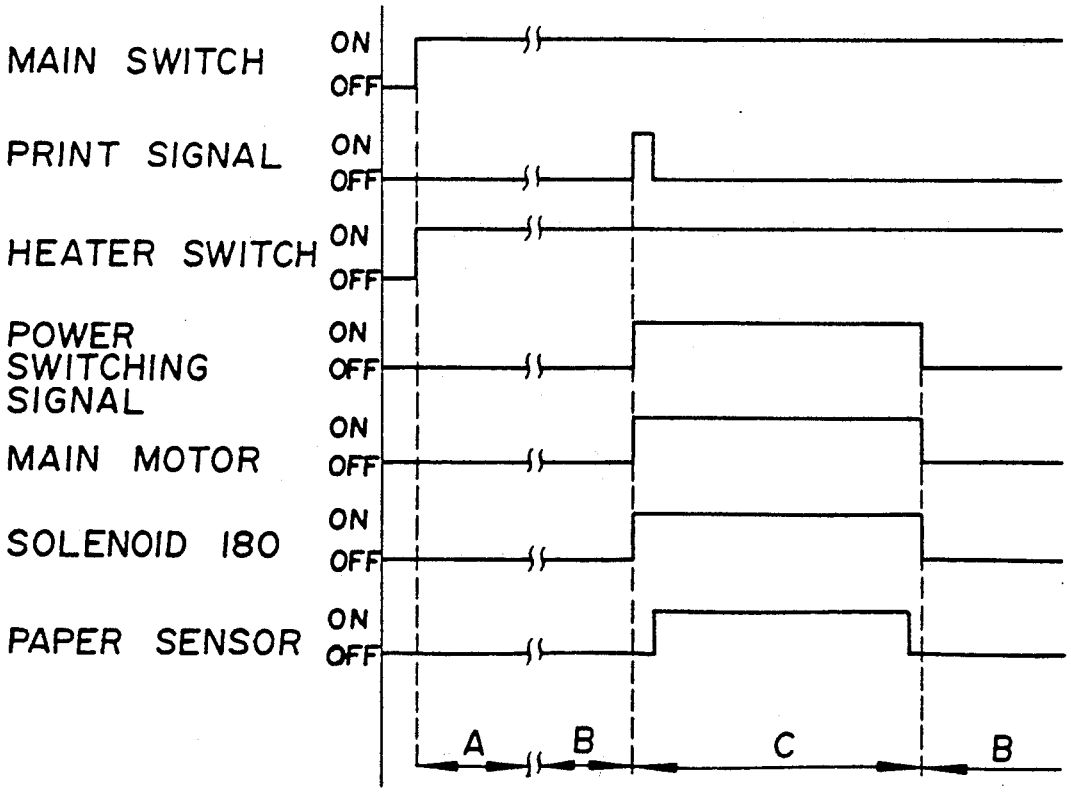
FIG. 30 is a time chart for controlling the heating portion of FIG. 29.

Subsequently, when a recording paper to which a toner image has been transferred at a transfer portion (not shown), reaches the paper sensor P, a detection signal is output from the paper sensor P to the CPU 190. Then, the trailing edge of the recording paper finishes passing through the paper sensor P, the paper signal is turned OFF, so that the main motor M and the solenoid 180 are turned off at a predetermined time after the OFF paper signal. In FIG. 30, A is a so-called warm-up region, B is a region where the fixing roller 150 rotates, and C is a region where the fixing roller 150 is stopped.

Furthermore, although in this embodiment the fixing roller 150 is stopped during the warm-up time, it may rotate during the stand-by time. In this embodiment, although the pressure roller 152 is locally heated at the portion corresponding to the nip n when the fixing roller 150 is stopped, it is not anticipated that uneven fixing occurs, since the pressure roller 152 is evenly heated by rotation thereof until the recording paper reaches the image fixing device 28 after the print signal PS is input. In addition, since the pressure roller 152 is locally heated at the portion corresponding to the nip n, there is an advantage in that it is possible to carry out the fixing immediately after the power is turned on in the morning.

Figure 31:
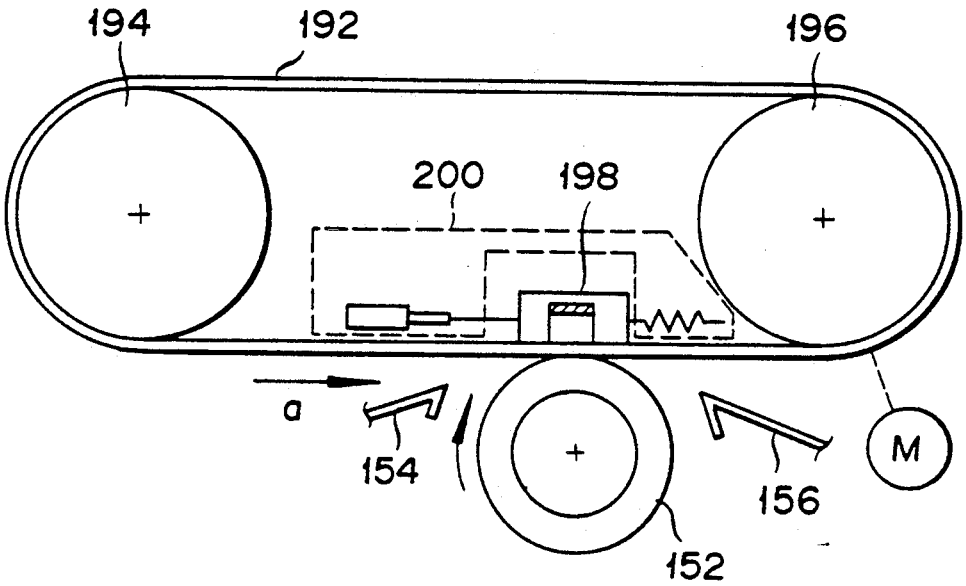
FIG. 31 is a schematic plan view of the twenty-first preferred embodiment of an image fixing device, according to the present invention.
Figure 32:
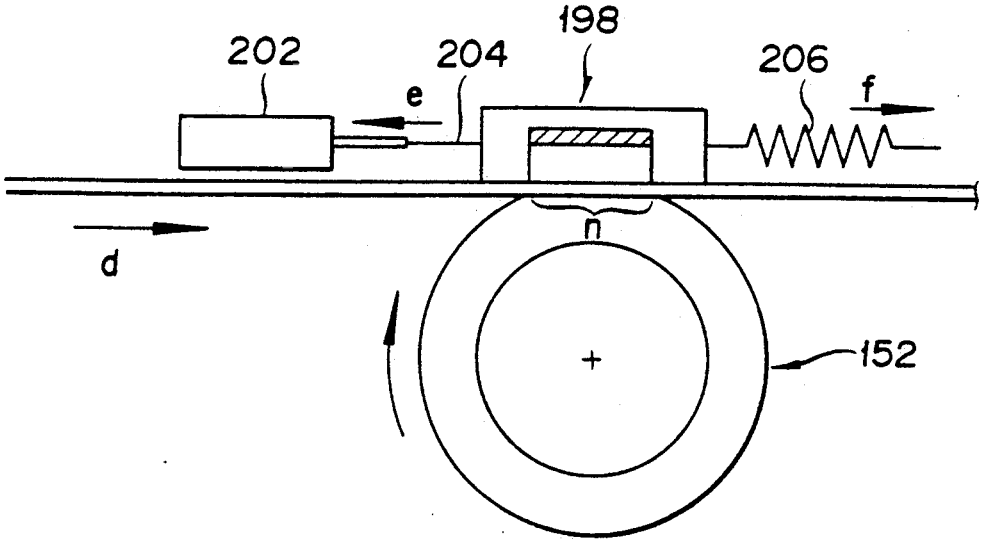
FIG. 32 is a schematic plan view of a main portion of the image fixing device of FIG. 31.

FIGS. 31 and 32 show the twenty-first preferred embodiment of an image fixing device, according to the present invention.

In this embodiment, a fixing belt 192 of a heat resistance film having high heat conductivity is substituted for the fixing roller 150. The fixing belt 192 is wound onto a pair of rollers 194 and 196 which are separated to each other by a predetermined distance, so as to move in the direction of arrow d in accordance with rotation of the rollers 194 and 196 which are driven by means of a main motor M. On the inner surface side of the fixing belt 192, a heating portion 198 and an oscillating portion 200 which causes the oscillation of the heating portion 198 are provided. The heating portion 198 is kept in contact with the inner surface of the fixing belt 192. The pressure roller 152 is so arranged as to press the outer surface of the fixing belt 192 at a location corresponding to the heating portion 198.

As shown in FIG. 32, the oscillating portion 200 comprises a solenoid 202 which causes the heating portion 198 to move in the direction of arrow e in FIG. 32; a linking rod 204 for connecting the solenoid 202 to the heating portion 198; and a regulating spring 206 for biasing the heating portion 198 in the direction of the arrow f in FIG. 32 to set the heating portion 198 at a position corresponding to the nip n when the fixing belt 192 is stopped. Furthermore, when the solenoid 202 is turned off, the movement of the heating portion 198 in the direction of arrow f is restrained by a stopper (not shown) so as to be stopped at the position corresponding to the nip n.

When the fixing belt 192 is stopped, the solenoid 202 is turned off, so that the heating portion 198 is stopped at the position corresponding to the nip n. On the other hand, when the fixing belt 192 moves, the solenoid is turned on, so that the heating portion 198 is moved from the position corresponding to the nip n upstream relative to the direction of movement of the fixing belt 192 by a predetermined distance L(mm) similar to the twentieth preferred embodiment.

In the aforementioned twentieth and twenty-first preferred embodiments, for example, gears driven by a motor may be substituted for the solenoid 202 serving as moving means.

As mentioned above, according to the aforementioned twentieth and twenty-first preferred embodiments, the heat energy transmitted to the inner surface can be assuredly transmitted to the nip without radiation thereof to a portion other than the nip, so that an image fixing device having very low heat loss can be provided. In addition, it is possible to prevent the temperature within the apparatus from being needlessly increased, so that parts which have low resistance to heat, such as control circuits, can be arranged near the image fixing device, making it possible to thereby reduce the size of the image forming apparatus.

Referring to FIGS. 33(A) and 33(B), and 34(A) and 34(B), the twenty-second preferred embodiment of an image fixing device, according to the present invention, will be described below.

In this embodiment, the fixing roller 30 houses therein a supporting member 210 of sheet metal which has a substantially H-shaped cross-section and which extends in the longitudinal direction of the fixing roller 30. Both ends of the supporting member 210 are secured to the frame of the laser-beam printer. The supporting member 210 is connected to one surface of an elongated heat insulating member 212 via springs 214. To the other surface of the heat insulating member 212, one surface of a heating element 216 is secured. On the other surface of the heating element 216, a resistance material is printed. When a voltage is applied to the resistant material via a terminal 218, the resistance material produces heat of a high temperature. The heat insulating member 212 serves to prevent the heat produced by the heating element 216 from being scattered to the supporting member 210.

Figure 33B:
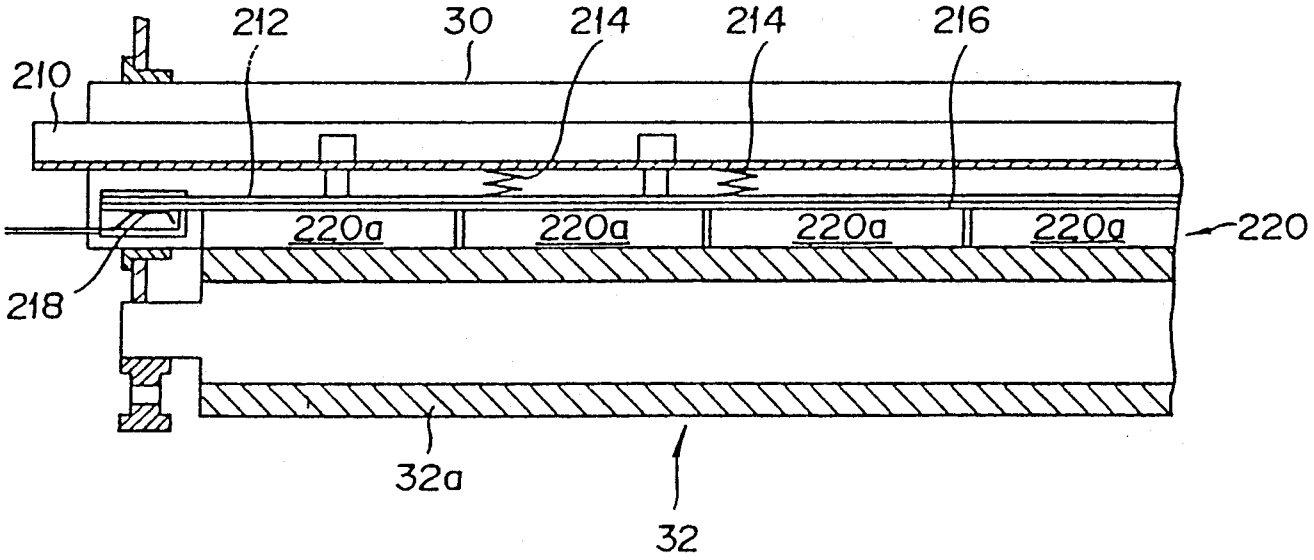
FIGS. 33(A) and 33(B) are, respectively, laterally and longitudinally sectional views of the twenty-second preferred embodiments of an image fixing device, according to the present invention, taken along lines perpendicular and parallel to the longitudinal axis of a fixing roller, respectively.
Figure 33A:
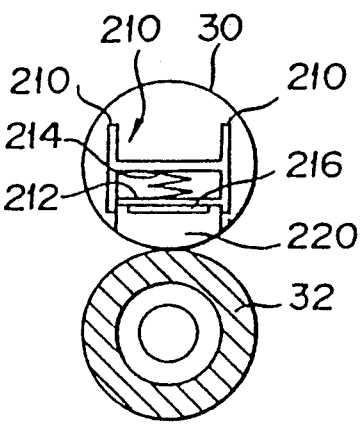
Figure 34B:
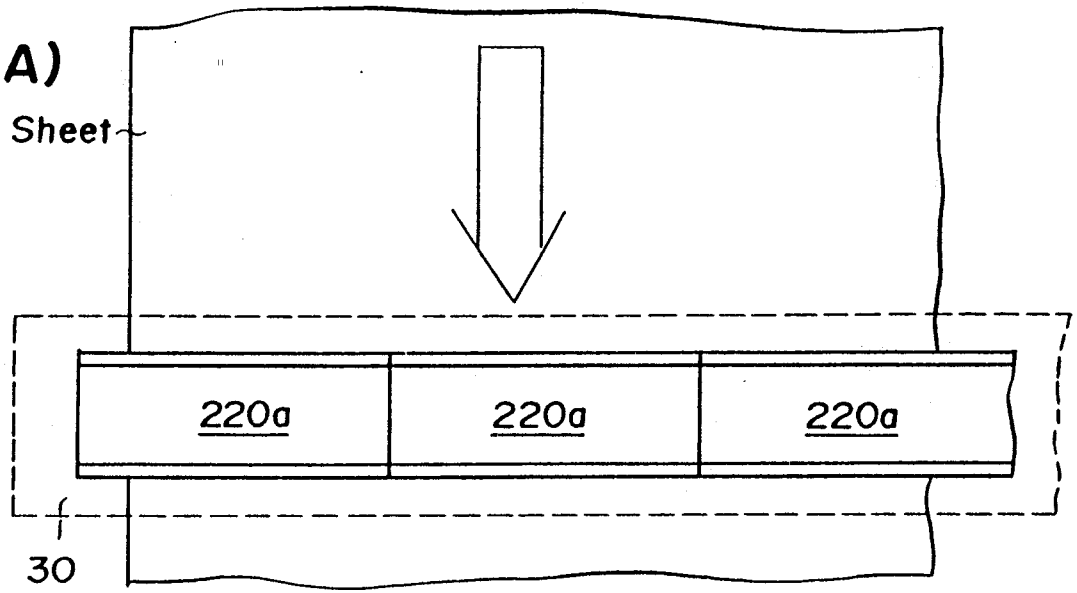
FIGS. 34(A) and 34(B) are schematic plan views of heat conductive blocks serving as heat conductive means of the image fixing device of FIGS. 33(A) and 33(B), as seen in directions parallel and perpendicular to the axis of the heat conductive means.
Figure 34A:
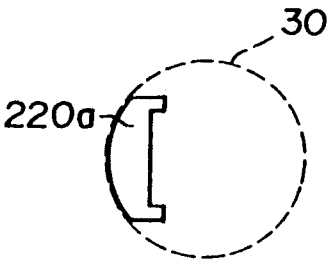

As can be seen clearly from FIG. 33(A), heat conductive means 220 is secured to the heat insulating member 212 so as to surround the heating element 216. The heat conductive means 220 comprises a plurality of heat conductive blocks 220*a* which are arranged in series so as to extend in the longitudinal direction of the fixing roller 30. Each of the heat conductive blocks 220*a* has a curved surface having substantially the same curvature as that of the inner surface of the fixing roller 30. The curved surface of the heat conductive blocks 220*a* is pressed against the inner surface of the fixing roller 30 due to the biasing force of the springs 214, so that it is kept in contact with the inner surface of the fixing roller 30 at and around the nip 40 (at the contact portion of the fixing roller 30 with the pressure roller 32). When the fixing roller 30 rotates, the heat conductive blocks 220*a* slide on the inner wall of the fixing roller 30.

The operation of the image fixing device 28, according to this embodiment, is substantially the same as that of the first preferred embodiment. Therefore, as in the case of the first preferred embodiment, in this embodiment, the time necessary to heat the fixing roller 30 can be decreased without increasing the heating value of the heating element 216, so that it is possible to prevent the temperature increasing within an apparatus, such as a laser-beam printer. It is also possible to prevent the demand current of the heating element 216 from increasing. Furthermore, since the toner is fixed to the sheet when the sheet is removed from the fixing roller 30, it is difficult for the toner to adhere to the fixing roller 30, so that it is possible to prevent offset. Since the adhesive strength of the toner on the sheet is decreased, the sheet can be easily removed from the fixing roller to prevent the jamming of the sheet in the apparatus.

In this embodiment, the longitudinal length of each of the heat conductive blocks 220*a* is relatively short, so that it is possible to easily manufacture straight heat conductive blocks 220*a*, thereby making it possible to improve the manufacturing accuracy of the heat conductive blocks 220*a*. As a result, the heat conductive blocks 220*a* are pressed against the inner wall of the fixing roller 30 to enable tight contact therewith, so that the heat transmitted from the heat conductive blocks 220*a* is evenly transmitted to the inner wall of the fixing roller 30.

Even if undesired distortions occur in the heat conductive blocks 220*a* and the inner wall of the fixing roller 30 due to thermal expansion or insufficient manufacturing accuracy thereof, at least the distortions in the heat conductive blocks 220*a* can be accommodated by discontinuous portions between adjacent heat conductive blocks 220*a*, since the heat conductive blocks 220*a* are pressed against the inner wall of the fixing roller 30 by the biasing force of the spring 214. Therefore, the heat conductive blocks 220*a* are tightly kept in contact with the inner wall of the fixing roller 30, so that the heat transmitted from the heat conductive blocks 220*a* is evenly transmitted to the inner wall of the fixing roller 30. As a result, the temperature distribution on the inner wall of the fixing roller in the direction of the axis thereof can be even, so that the toner on the sheet in contact with the nip 40 of the fixing roller 30 is fused by heat at an even temperature applied to the sheet, thereby preventing the imperfect fixing of the toner.

Figure 35B:
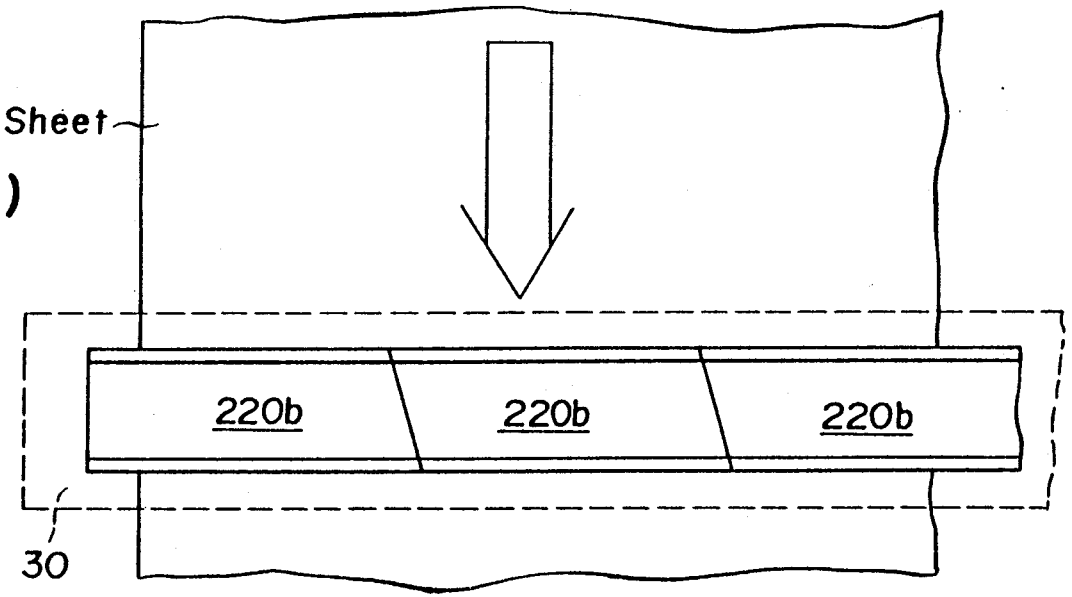
FIGS. 35(A) and 35(B) are schematic plan views of heat conductive blocks serving as heat conductive means in the twenty-third preferred embodiment of an image fixing device, according to the present invention, which plan views are seen in directions parallel and perpendicular to the axis of the heat conductive means.
Figure 35A:
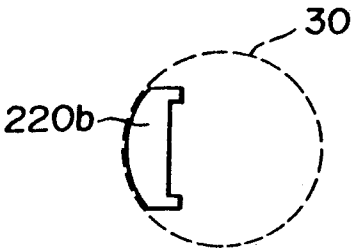

FIGS. 35(A) and 35(B) show the twenty-third preferred embodiment of an image fixing device, according to the present invention.

In this embodiment, the image fixing device 28 is substantially the same as that of the twenty-second preferred embodiment, except that heat conductive blocks 220*b* in which the surfaces opposed to the adjacent block are inclined relative to the longitudinal axis of the fixing roller 30, is substituted for the heat conductive blocks 220*a*. According to this embodiment, even if gaps between the adjacent heat conductive blocks 220*b* are present, the heat conductive blocks 220*b* can evenly slide on the inner wall of the fixing roller 30 when the fixing roller 30 rotates. Therefore, any portions on the inner wall of the fixing roller 30 can be kept in contact with the heat conductive blocks 220*b*, making it possible to prevent the decrease in temperature of the discontinuous portions between the adjacent heat conductive blocks 220*b*. As a result, the temperature distribution in the inner wall of the fixing roller 30 in the direction of axis thereof is even, and imperfect fixing of the toner to the sheet is prevented.

Figure 36:
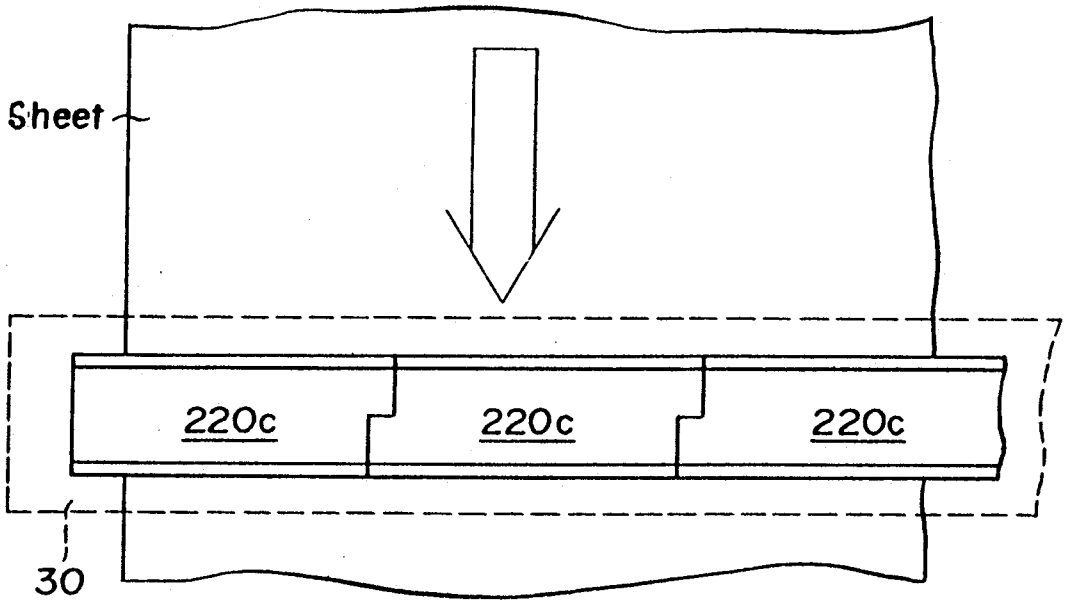
FIG. 36 is a schematic plan view of heat conductive blocks serving as heat conductive means in the twenty-fourth preferred embodiment of an image fixing device according to the present invention, which plan view is seen in the direction perpendicular to the axis of the heat conductive means.

FIG. 36 shows the twenty-fourth preferred embodiment of an image fixing device, according to the present invention.

In this embodiment, the image fixing device 29 is substantially the same as that of the twenty-second preferred embodiment, except that heat conductive blocks 220*c* which have a step which is engageable with the step of the adjacent block, are substituted for the heat conductive blocks 220*a*. In this embodiment, there is the same advantage as that of the twenty-third preferred embodiment.

In the aforementioned twenty-second to twenty-fourth preferred embodiments, grease having high heat conductivity may be applied to the adjacent surfaces of the heat conductive blocks 220*a* to 220*c*. In this case, it is not only possible to prevent gaps from occurring between the adjacent heat conductive blocks 220*a* to 220*c*, but it is also possible to decrease the temperature difference between the respective heat conductive blocks 220*a* to 220*c*. As a result, the temperature distribution in the longitudinal axis of the fixing roller 30 may be more even, so that it is possible to prevent imperfect fixing. In addition, when grease is applied to the portion between the heat conductive block 220*a* to 220*c* and the heating element 216 or the inner wall of the fixing roller 30, it is possible to prevent a decrease in the heat conductivity from gaps (air layer) therebetween.

As mentioned above, according to the aforementioned twenty-second to twenty-fourth preferred embodiments, the heat conductive means can be assuredly kept in contact with the inner wall of the fixing roller by dividing the heat conductive means into a plurality of heat conductive blocks, so that the temperature distribution in the longitudinal direction of the fixing roller is even, and it is thereby possible to prevent the imperfect fixing.

Figure 37B:
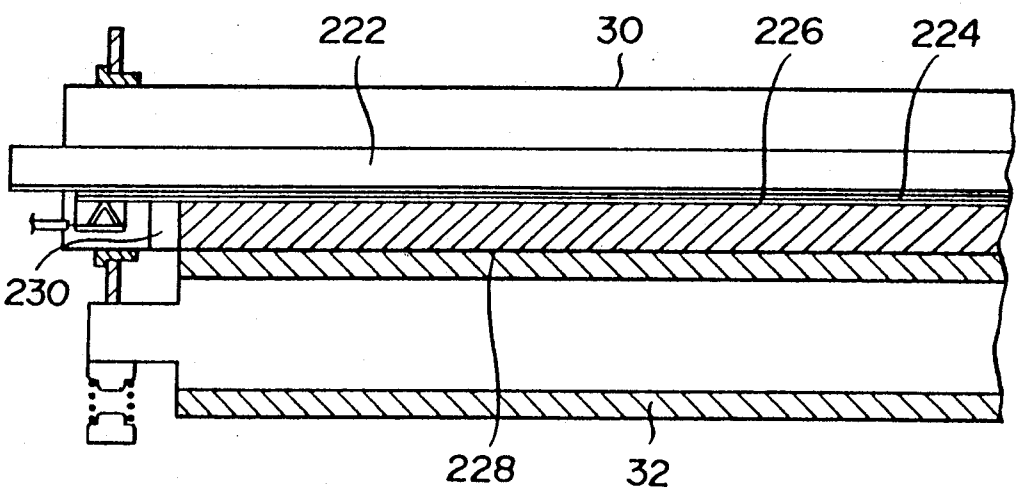
FIGS. 37(A) and 37(B) are, respectively, laterally and longitudinally sectional views of the twenty-fifth preferred embodiments of an image fixing device, according to the present invention, taken along lines perpendicular and parallel to the longitudinal axis of a fixing roller, respectively.
Figure 37A:
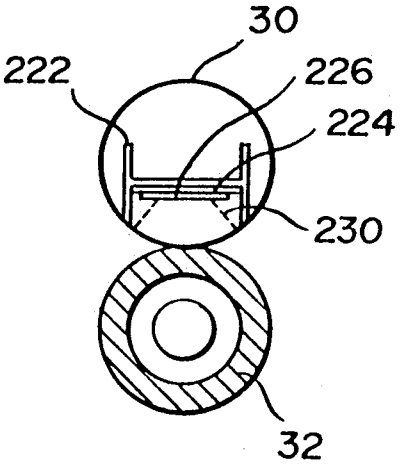
Figure 38:
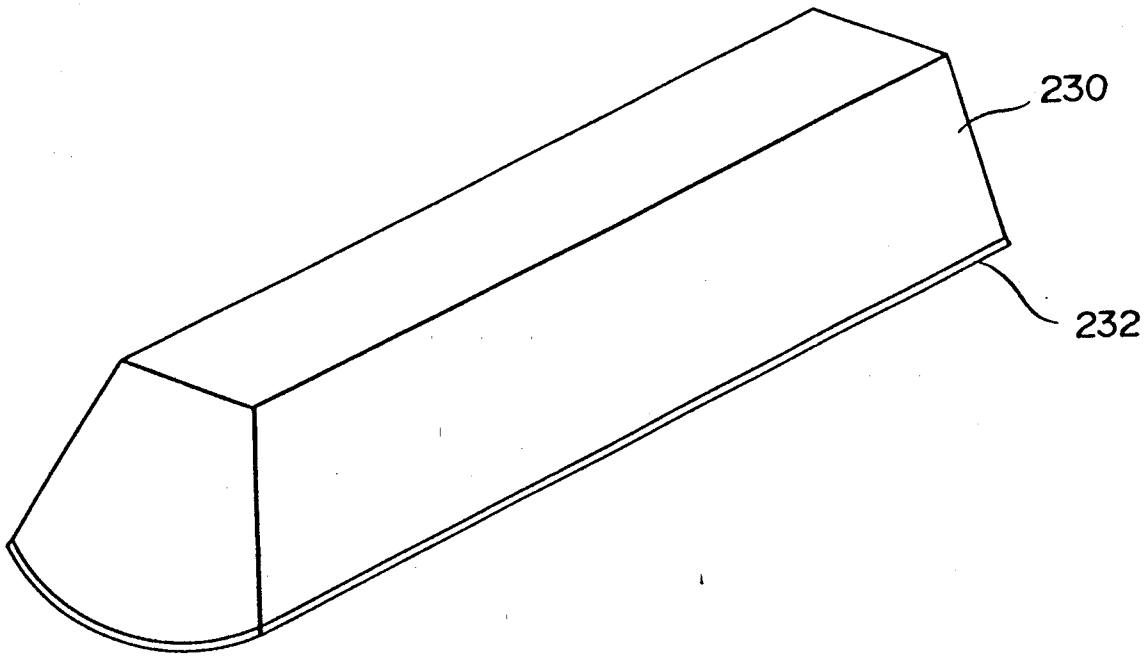
FIG. 38 is a perspective view of a casing of the image fixing device of FIGS. 37(A) and 37(B).

Referring to FIGS. 37(A), 37(B) and 38, the twenty-fifth preferred embodiment of an image fixing device, according to the present invention, will be described below.

In this embodiment, the fixing roller 30 houses therein a supporting member 222 which has a substantially H-shaped cross-section and which extends in the longitudinal direction of the fixing roller 30. An elongated heat insulating member 224 is secured to one surface of the supporting member 222, and a heating element 226 is secured to the heat insulating member 224. The heating element 226 is made of an electrical resistant material to produce high-temperature heat when voltage is applied thereto. The heat insulating member 224 serves to prevent the heat produced by the heating element 226 from being scattered to the supporting member 222. A heat conductive material 228 is retained by a casing 230 between the heating element 226 and the inner wall of the fixing roller 30.

The heat conductive material 228 is made of an alloy having a low melting point such that it is easily softened or fused when heat energy is applied thereto. This alloy will be hereinafter referred to as "fusible alloy". The fusible alloy may be an alloy which has the same composition as that of a three-component eutectic mixture, such as Rose alloy and Newton alloy, i.e. [Bi(50%)—Pb(31%)—Sn(19%)], and which is fused at a temperature of about 95° C. The fusible alloy may also be an alloy which has the same composition as that of a four-component eutectic mixture, such as Wood alloy, i.e. [Bi(50%)—Pb(24%)—Sn(14%)—Cd(12%), and which is fused at a temperature of about 70° C. When heat energy from the heating element 226 is applied to the heat conductive material 228, it is softened or fused while being retained within the casing 230.

The casing 230 has on both ends thereof a pair of curved edges having substantially the same curvature as that of the inner surface of the fixing roller 30, so as to surely retain the heat conductive material 228 between the casing 230 and the inner wall of the fixing roller 30. As can be seen clearly from FIG. 38, the peripheral edge of the casing 230 contacting with the inner wall of the fixing roller 30 is coated with a heat-resistant sealing member 232 so as to prevent the softened or fused, heat conductive material 228 from leaking out of the casing 230. In this embodiment, since the heat conductive material 228 can be softened or fused by the heat energy applied thereto from the heating element 226 which is evenly kept in contact with the inner wall of the fixing roller 30, it is possible to evenly heat the outer surface of the fixing roller 30 corresponding to the nip.

In this embodiment, although the heat conductive material is made of a fusible alloy, it may be made of other metals which are softened or fused at a temperature less than the fixing temperature, such as indium, and of thermoplastic resins, such as wax.

According to the present invention, the heat conductive means such as the heat conductive member or the heat conductive material, may be made of an electric conductive material connected to ground. In this case, in order to prevent the heating element from being connected to ground through the heat conductive means, it is preferable to insulate the heating element from the heat conductive means. With this construction, it is possible to effectively remove static electricity produced when the heat conductive means slides on the fixing means such as the fixing roller or the fixing belt, and thereby prevent the possibility of the toner being adhered to the fixing means by Coulomb force.

What is claimed is:

1. An image fixing device for an image forming apparatus, comprising:

rotatable fixing means defining therein a space;

pressure means for cooperating with said rotatable fixing means to form a nip therebetween for receiving a sheet to which a toner image has been transferred, said pressure means pressing the sheet against said rotatable fixing means at the nip; and heating means, arranged in said space, for locally heating an inner wall of said rotatable fixing means at a location corresponding to said nip to fix said toner image to said sheet, wherein said heating means comprises a heating element for producing heat, and heat conductive means for locally transmitting the heat to the inner wall of said rotatable fixing means at the location corresponding to said nip.

2. An image fixing device according to claim 1, wherein said heating element extends in a longitudinal direction of said rotatable fixing means.

3. An image fixing device according to claim 2, wherein said heat conductive means is kept in contact with said heating element and with the inner wall of said rotatable fixing means at the location corresponding to said nip.

4. An image fixing device according to claim 3, wherein said rotatable fixing means comprises a hollow cylindrical fixing roller, and said pressure means comprises a cylindrical pressure roller which is kept in contact with said fixing roller so as to rotate in accordance with the rotation thereof, said pressure roller being arranged in parallel with said fixing roller so that said nip extends in the direction of the longitudinal axes thereof.

5. An image fixing device according to claim 3, wherein said heat conductive means is made of a material of high heat conductivity, and extends in the longitudinal direction of said heating means.

6. An image fixing device according to claim 5, wherein said heating element comprises an elongated strip of a heat resistant material which produces heat when a voltage is applied thereto.

7. An image fixing device according to claim 6, wherein said heat conductive means comprises a metal strip which has a flat portion secured to said heating element and a curved portion which is kept in contact with the inner wall of said rotatable fixing means while pressing said rotatable fixing means.

8. An image fixing device according to claim 6, wherein said heat conductive means comprises an elongated hollow member which has a flat portion secured to said heating element and a curved portion which is kept in contact with the inner wall of said rotatable fixing means while pressing said rotatable fixing means.

9. An image fixing device according to claim 6, wherein said heat conductive means comprises an elongated rod which has a flat portion secured to said heating element and a curved portion which is kept in contact with the inner wall of said rotatable fixing means while pressing said rotatable fixing means.

10. An image fixing device according to claim 6, wherein said heat conductive means comprises a rotatable cylindrical roller which is kept in contact with both of said heating element and the inner wall of said rotatable fixing means, said heat conductive means rotating in accordance with the rotation of said rotatable fixing means in the reverse direction thereof.

11. An image fixing device according to claim 7, wherein said metal strip has a plurality of cutoffs so as to have a comb-shaped cross-section.

12. An image fixing device according to claim 6, wherein said heat conductive means comprises a rotatable shaft, and a heat conductive brush having a plurality of bristles which extend radially from said shaft, said brush being kept in contact with both of said heating element and the inner wall of said rotatable fixing means, said rotatable shaft rotating in accordance with the rotation of said rotatable fixing means.

13. An image fixing device according to claim 6, wherein said heat conductive means comprises a heat conductive plate contacting with said heating element, and a heat conductive brush having a plurality of bristles which extend from said conductive plate so as to be kept in contact with the inner wall of said rotatable fixing means.

14. An image fixing device according to claim 1, wherein said heating element comprises an elongated halogen lamp.

15. An image fixing device according to claim 1, wherein said heating element has a substantially circular cross-section.

16. An image fixing device according to claim 15, wherein said heat conductive means comprises a hollow cylinder of a heat conductive material surrounding said heating element, and a heat conductive brush having a plurality of bristles which extend from said hollow cylinder so as to be kept in contact with the inner wall of said rotatable fixing means.

17. An image fixing device according to claim 15, wherein said heat conductive means comprises a heat conductive rod, and a heat conductive brush having a plurality of bristles which extend radially from said rod, said brush being kept in contact with both of said heating element and the inner wall of said rotatable fixing means.

18. An image fixing device according to claim 15, wherein said heat conductive means comprises a heat conductive strip which has a first curved portion surrounding said heating element without contacting therewith, and a second curved portion which is kept in contact with the inner wall of said rotatable fixing means.

19. An image fixing device according to claim 1, which further comprises temperature detecting means for detecting the temperature of said heating means.

20. An image fixing device according to claim 7, which further comprises temperature detecting means, arranged between said heating element and the inner wall of said rotatable fixing means, for detecting temperatures of an air layer therebetween.

21. An image fixing device according to claim 13, which further comprises temperature detecting means, secured to said heat conductive means, for detecting temperature of said heat conducive means.

22. An image fixing device according to claim 7, which further comprises a supporting member on which said heating element is supported, and temperature detecting means being secured to said supporting member for detecting temperature of said supporting member.

23. An image fixing device according to claim 4, wherein said heat conductive means comprises a plurality of heat conductive blocks arranged in series so as to extend in the longitudinal direction of said rotatable fixing means.

24. An image fixing device according to claim 23, wherein each of said heat conductive blocks has a curved surface having substantially the same curvature as that of the inner wall of said fixing roller.

25. An image fixing device according to claim 24, which further comprises biasing means for pressing said heat conductive blocks against the inner wall of said fixing roller.

26. An image fixing device according to claim 23, wherein said heat conductive blocks have a step engageable with the step of the adjacent block.

27. An image fixing device according to claim 23, which further comprises a heat conductive fluid applied between the adjacent heat conductive blocks for preventing a gap from being formed therebetween.

28. An image fixing device according to claim 4, wherein said heat conductive means is made of a material which is softened or fused at a temperature less than a fixing temperature.

29. An image fixing device according to claim 28, which further comprises a casing for retaining said heat conductive means while bringing said heat conductive means into contact with said heating element and said inner wall of said fixing roller.

30. An image fixing device according to claim 3, wherein said heat conductive means is made of electric conductive material, said heat conductive means being electrically connected to ground.

31. An image fixing device according to claim 3, which further comprises a supporting member on which said heating element is supported via a heat insulating member.

32. An image fixing device according to claim 3, which further comprises a heat conductive lubricant applied between said heat conductive means and said inner wall of said rotatable fixing means.

33. An image fixing device according to claim 3, which further comprises a heat conductive material applied between said heat conductive means and said inner wall of said rotatable fixing means for preventing a gap from being formed therebetween.

34. An image fixing device according to claim 3, wherein said heat conductive means is made of elastic material.

35. An image fixing device according to claim 3, which further comprises a heat conductive fluid applied between said heat conductive means and said heating element.

36. An image fixing device according to claim 1, wherein said rotatable fixing means comprises a pair of rotatable rollers separated from each other by a predetermined distance, and a fixing belt of high heat conductivity wound onto said rollers to rotate in accordance with the rotations of said rollers.

37. An image fixing device according to claim 36, wherein said heating means comprises a heating element for producing heat, a plurality of metallic beads serving as heat conductive means for locally transmitting the heat to the inner wall of said fixing roller, and retaining means for defining a chamber to retain said metallic bead therein.

38. An image fixing device for an image forming apparatus, comprising:

rotatable fixing means defining therein a space;

pressure means for cooperating with said rotatable fixing means to form a nip therebetween for receiving a sheet to which a toner image has been transferred, said pressure means pressing the sheet against said rotatable fixing means at the nip;

a heating element, arranged in said space, for producing heat;

heat conductive means for transmitting the heat to an inner wall of said rotatable fixing means at a location corresponding to said nip, said heat conductive means including a plurality of beads; and retaining means for retaining said beads between said heating element and the inner wall of said fixing means at a location corresponding to said nip, so as to bring said beads into contact with the inner wall of said fixing means.

39. An image fixing device according to claim 38, wherein said beads are made of a metal, and said retaining means includes a magnet for forming a magnetic field between said heating element and said fixing means to cause said beads to serve as a magnetic brush extending from said heating element to said inner wall of said fixing means.

40. An image fixing device according to claim 39, wherein said heating element is arranged between said magnet and said beads.

41. An image fixing device according to claim 39, wherein the other end of said magnetic brush is kept in contact with said magnet, and said heating element is arranged on a side of said magnetic brush so as to prevent said magnetic brush from being deformed due to the rotation of said fixing roller.

42. An image fixing device according to claim 38, wherein said retaining means defines a chamber to retain said beads therein.

43. An image fixing device according to claim 42, wherein said retaining means comprises a metal sheet which has a pair of regulating portions for preventing said beads from being dispersed due to rotation of said fixing means.

44. An image fixing device according to claim 42, wherein said chamber is formed by a pair of magnet for preventing said beads from being dispersed due to rotation of said fixing means.

45. An image fixing device for an image forming apparatus, comprising:

rotatable fixing means defining therein a space;

pressure means for cooperating with said rotatable fixing means to form a nip therebetween for receiving a sheet to which a toner image has been transferred, said pressure means pressing the sheet against said rotatable fixing means at the nip;

heating means, arranged in said space, for locally heating an inner wall of said rotatable fixing means at a location corresponding to said nip to fix said toner image to said sheet; and moving means for causing said heating means to move between a first position at which said heating means heats up the inner wall of said rotatable fixing means at a location corresponding to said nip, and a second position separated from said first position.

46. An image fixing device according to claim 45, wherein said moving means causing said heating means to be positioned at said first position when said rotatable fixing means is stopped, and at said second position when said rotatable fixing means rotates.

47. An image fixing device according to claim 46, wherein said second position is a position upstream relative to the direction of rotation of said rotatable fixing means.

48. An image fixing device according to claim 47, wherein said distance is set on the basis of the following equation:

$$L = Vs(2X/\pi h)$$

wherein Vs is a travel speed of said rotatable fixing means, X is a thickness thereof, and h is a thermal diffusivity thereof.

49. An image fixing device according to claim 46, wherein said rotatable fixing means comprises a hollow cylindrical fixing roller, and said pressure means comprises a cylindrical pressure roller which is kept in contact with said fixing roller so as to rotate in accordance with the rotation thereof, said pressure roller being arranged in parallel with said fixing roller so that said nip extends in the direction of the longitudinal axes thereof.

50. An image fixing device according to claim 46, wherein said rotatable fixing means comprises a pair of rotatable rollers separated from each other by a predetermined distance, and a fixing belt of high heat conductivity wound onto said rollers to rotate in accordance with the rotations of said rollers.

51. An image fixing device according to claim 45, wherein said heating means includes a heating element for producing heat, and heat conductive means for transmitting the heat to the inner wall of said rotatable fixing means, and wherein said moving means causes said heat conductive means to move between said first and second positions.

52. An image fixing device for an image forming apparatus, comprising:

rotatable fixing means defining therein a space;

pressure means for cooperating with said rotatable fixing means to form a nip therebetween for receiving a sheet to which a toner image has been transferred, said pressure means pressing the sheet against said rotatable fixing means at the nip; and heating means, arranged in said space, for producing heat;

heat conductive means for transmitting to an inner wall of said rotatable fixing means;

detecting means for detecting the temperature of said heat conductive means to produce a signal indicative thereof; and control means for controlling the heat of said heating element.

* * * * *